US010704500B2

(12) United States Patent
Asanuma et al.

(10) Patent No.: US 10,704,500 B2
(45) Date of Patent: Jul. 7, 2020

(54) EVAPORATED FUEL TREATMENT DEVICE

(71) Applicant: AISAN KOGYO KABUSHIKI KAISHA, Obu-shi, Aichi (JP)

(72) Inventors: Daisaku Asanuma, Gamagori (JP); Nobuhiro Kato, Toykai (JP)

(73) Assignee: AISAN KOGYO KABUSHIKI KAISHA, Obu-Shi, Aichi (JP)

( * ) Notice: Subject to any disclaimer, the term of this patent is extended or adjusted under 35 U.S.C. 154(b) by 0 days.

(21) Appl. No.: 16/331,417

(22) PCT Filed: Jun. 23, 2017

(86) PCT No.: PCT/JP2017/023270
§ 371 (c)(1),
(2) Date: Mar. 7, 2019

(87) PCT Pub. No.: WO2018/051605
PCT Pub. Date: Mar. 22, 2018

(65) Prior Publication Data

US 2019/0203666 A1 Jul. 4, 2019

(30) Foreign Application Priority Data

Sep. 13, 2016 (JP) ..... 2016-178650
Mar. 10, 2017 (JP) ..... 2017-046101

(51) Int. Cl.
*F02M 25/08* (2006.01)
*F02M 37/22* (2019.01)
(Continued)

(52) U.S. Cl.
CPC ..... *F02M 25/08* (2013.01); *F02M 37/0023* (2013.01); *F02M 37/04* (2013.01); *F02M 37/22* (2013.01)

(58) Field of Classification Search
CPC .... F02M 25/08; F02M 37/0023; F02M 37/04; F02M 37/22
See application file for complete search history.

(56) References Cited

U.S. PATENT DOCUMENTS 5,572,979 A * 11/1996 Czadzeck ..... F02M 29/14 123/568.17
5,763,764 A * 6/1998 Mieczkowski .... F02M 25/0809 73/114.39
(Continued)

FOREIGN PATENT DOCUMENTS

JP S57-171021 A 10/1982
JP 2002-213306 A 7/2002
(Continued)

OTHER PUBLICATIONS

English Translation of the Written Opinion for PCT/JP2017/023270 dated Sep. 12, 2017 (6 pages).
(Continued)

*Primary Examiner* — Joseph J Dallo
(74) *Attorney, Agent, or Firm* — Shumaker, Loop & Kendrick, LLP

(57) ABSTRACT

An evaporated fuel processing device may comprise a canister, a control valve disposed on a purge passage and switching between a closed state being a state of closing the purge passage and an open state being a state of opening the purge passage, a pump disposed between the canister and the control valve, an acquiring unit acquiring a characteristic value related to a characteristic of the pump in a situation where the control valve is in the closed state and the pump pressurizes gas in the purge passage on a control valve side relative to the pump, and an estimating unit estimating a flow rate of the gas that the pump discharges to the purge
(Continued)

passage on the control valve side when the control valve is in the open state, by using the acquired characteristic value.

13 Claims, 17 Drawing Sheets

(51) Int. Cl.
*F02M 37/04* (2006.01)
*F02M 37/00* (2006.01)

(56) References Cited

U.S. PATENT DOCUMENTS 6,138,644 A * 10/2000 Saruwatari ..... F02D 41/004 123/519
6,659,087 B1 * 12/2003 Reddy ..... F02D 41/0045 123/357
9,897,045 B2 2/2018 Makino
2006/0065253 A1 * 3/2006 Reddy ..... F02M 25/089 123/520
2014/0324284 A1 * 10/2014 Glinsky ..... G07C 3/08 701/34.4
2015/0025781 A1 * 1/2015 Pearce ..... F02D 41/22 701/114
2015/0120165 A1 * 4/2015 Glinsky ..... G07C 5/00 701/101
2015/0354510 A1 * 12/2015 Dudar ..... F02M 25/0818 73/40.7
2016/0115912 A1 * 4/2016 Takagawa ..... B60T 17/02 123/518
2016/0115913 A1 * 4/2016 Doke ..... F02M 25/0818 123/520
2017/0082038 A1 * 3/2017 Dudar ..... F02M 25/0836
2017/0137022 A1 * 5/2017 Dudar ..... B60W 50/14
2017/0159588 A1 6/2017 Hongo
2017/0234270 A1 * 8/2017 Tochihara ..... F02M 25/0818 123/519
2017/0291600 A1 * 10/2017 Styles ..... G07C 5/0825

FOREIGN PATENT DOCUMENTS

JP 2003-042008 A 2/2003
JP 2004-116303 A 4/2004
JP 2006-144601 A 6/2006
JP 2007-177728 A 7/2007
JP 2007-198267 A 8/2007
JP 2014-020332 A 2/2014
JP 2014-101776 A 6/2014
JP 2016-164386 A 9/2016
JP 2017-106334 A 6/2017

OTHER PUBLICATIONS

English Translation International Search Report (ISR) for PCT/JP2017/023270 dated Sep. 12, 2017 (2 pages).

* cited by examiner

EVAPORATED FUEL TREATMENT DEVICE

TECHNICAL FIELD

The description herein relates to a technique related to an evaporated fuel processing device mounted in a vehicle.

BACKGROUND ART

Japanese Patent Application Publication No. 2002-213306 describes an evaporated fuel processing device. The evaporated fuel processing device is provided with a canister configured to store fuel evaporated in a fuel tank, a control valve disposed on a purge passage communicating the canister and an intake passage, and a pump disposed on the purge passage. The evaporated fuel processing device drives the pump to discharge mixed gas (hereinbelow termed "purge gas") containing the evaporated fuel in the canister and air to the intake passage through the purge passage.

In the evaporated fuel processing device, a quantity of fuel to be supplied to an engine is controlled by decreasing or stopping a flow rate from the pump when an air-fuel ratio is rich, and by increasing the flow rate from the pump when the air-fuel ratio is lean.

SUMMARY

When a flow rate of purge gas from a pump changes, an air-fuel ratio changes. Due to this, the flow rate of the purge gas from the pump needs to be specified appropriately. The flow rate of the purge gas from the pump may vary depending on an individual difference of the pump, a chronological deterioration thereof, and a gas density. The art disclosed herein provides a technique that is capable of appropriately specifying a flow rate of gas discharged from a pump based on a characteristic of the pump.

The art disclosed herein relates to an evaporated fuel processing device. The evaporated fuel processing device may comprise: a canister configured to store evaporated fuel; a control valve disposed on a purge passage communicating the canister and an intake passage of an engine and configured to switch between a closed state and an open state, the closed state being a state of closing the purge passage, and the open state being a state of opening the purge passage; a pump disposed on the purge passage between the canister and the control valve; an acquiring unit configured to acquire a characteristic value related to a characteristic of the pump in a situation where the control valve is in the closed state and the pump pressurizes gas in the purge passage on a control valve side relative to the pump; and an estimating unit configured to estimate a flow rate of the gas that the pump discharges to the purge passage on the control valve side when the control valve is in the open state, by using the acquired characteristic value.

When the pump is driven while the control valve is in the closed state, the gas between the pump and the control valve is pressurized by the pump. In a case where there is a variation in the flow rate of the gas discharged from the pump, the characteristic value of the pump in the situation where the control valve is in the closed state and the pump pressurizes the gas in the purge passage on the control valve side varies in correlation to the variation in the flow rate. Due to this, the flow rate of the gas that the pump discharges to the purge passage on the control valve side when the control valve is in the open state may be estimated by using the characteristic value of the pump. According to this configuration, the flow rate of the gas discharged from the pump may be estimated by using the characteristic of the pump that is actually mounted in the evaporated fuel processing device. As a result, the flow rate of the gas discharged from the pump may suitably be estimated.

The acquiring unit may comprise a first pressure detecting unit configured to detect a pressure in the purge passage on the control valve side. The characteristic value may include a closed pressure value detected by the first pressure detecting unit. According to this configuration, the characteristic value of the pump may be acquired by using the first pressure detecting unit.

The characteristic value may include the closed pressure value in a situation where the control valve is in the closed state while the control valve continuously switches between the closed state and the open state. The acquiring unit may be further configured to acquire an open pressure value detected by the first pressure detecting unit in a situation where the pump discharges the gas to the purge passage on the control valve side and the control valve is in the open state while the control valve continuously switches between the closed state and the open state. The characteristic value may further include the open pressure value. The estimating unit may be configured to estimate the flow rate of the gas by using a difference between the closed pressure value and the open pressure value. According to this configuration, the flow rate of the gas discharged from the pump may be estimated while the control valve continuously switches between the closed state and the open state, that is, while the gas (that is, purge gas) is supplied to the intake passage. As a result, a quantity of fuel supplied to the engine may be estimated by using the estimated flow rate of the gas discharged from the pump.

The acquiring unit may comprise a voltage detecting unit configured to detect a voltage of the pump; and a current detecting unit configured to detect a current of the pump. The characteristic value may include a closed voltage value detected by the voltage detecting unit and a closed current value detected by the current detecting unit, the closed voltage value and the closed current value being detected when the pump is driven at a predetermined rotational speed. A voltage value and a current value while the pump is driven at a certain rotational speed vary depending on an individual difference of the pump. According to this configuration, the flow rate of the gas discharged from the pump may be estimated by using the closed voltage value and the closed current value which are correlated with the individual difference of the pump.

The characteristic value may include the closed voltage value and the closed current value in a situation where the control valve is in the closed state while the control valve continuously switches between the closed state and the open state. The acquiring unit may be further configured to acquire an open current value detected by the current detecting unit in a situation where the pump discharges the gas to the purge passage on the control valve side and the control valve is in the open state while the control valve continuously switches between the closed state and the open state. The estimating unit may be configured to estimate the flow rate of the gas by using the closed voltage value and a difference between the closed current value and the open current value. According to this configuration, the flow rate of the gas discharged from the pump may be estimated while the control valve continuously switches between the closed state and the open state, that is, while the purge gas is supplied to the intake passage. As a result, the quantity of fuel supplied to the engine may be estimated by using the estimated flow rate of the gas discharged from the pump.

The canister may be configured to communicate with open air via an open air passage. The evaporated fuel processing device may further comprise an open air valve configured to switch between a communicating state and a non-communicating state, the communicating state being a state where the canister communicates with the open air via the open air passage and the non-communicating state being a state where the canister does not communicate with the open air via the open air passage. The acquiring unit may comprise a second pressure detecting unit configured to detect a pressure in the open air passage on a canister side relative to the open air valve. The characteristic value may include a non-communicating pressure value detected by the second pressure detecting unit in a situation where the open air valve is in the non-communicating state. According to this configuration, the open air passage on the canister side relative to the open air valve may be brought to have a negative pressure by switching the open air valve to the non-communicating state while the pump is driven. A magnitude of the negative pressure at this occasion is correlated with the individual difference of the pump. Due to this, the flow rate of the gas discharged from the pump may be estimated by using the non-communicating pressure value.

The characteristic value may include the non-communicating pressure value in a situation where the control valve is in the closed state while the control valve continuously switches between the close state and the open state. The acquiring unit may further be configured to acquire a second non-communicating pressure value detected by the second pressure detecting unit in a situation where the pump discharges the gas to the purge passage on the control valve side, the control valve is in the open state while the control valve continuously switches between the closed state and the open state, and the open air valve is in the non-communicating state. The estimating unit may be configured to estimate the flow rate of the gas by using a difference between the non-communicating pressure value and the second non-communicating pressure value. According to this configuration, the flow rate of the gas discharged from the pump may be estimated while the control valve continuously switches between the closed state and the open state, that is, while the purge gas is supplied to the intake passage. As a result, the quantity of fuel supplied to the engine may be estimated by using the estimated flow rate of the gas discharged from the pump.

The acquiring unit may further comprise a temperature detecting unit configured to detect a temperature in the pump. The characteristic value may further include a temperature detected by the temperature detecting unit while the pump is driven. A density of the gas in the pump varies according to the temperature in the pump. For example, even if the pump is driven at a constant rotational speed, the flow rate of the gas discharged from the pump changes when the gas density changes. According to this configuration, the flow rate of the gas discharged from the pump may be estimated by taking into account the change in the characteristic of the pump caused by the temperature in the pump.

The estimating unit may store a standard flow rate of the gas discharged from the pump to the purge passage on the control valve side in a situation where the control valve is in the open state. The estimating unit may be configured to estimate the flow rate of the gas by using the characteristic value to specify a coefficient indicating a discrepancy from the standard flow rate and using the specified coefficient to modify the standard flow rate.

The evaporated fuel processing device may further comprise a control unit configured to continuously switch the control valve between the open state and the closed state. The control unit may be configured to switch the control valve according to a duty cycle, the duty cycle indicating a ratio of duration of the open state to duration of one set of the open state and the closed state that continuously take place while the control valve continuously switches between the closed state and the open state. The gas, which is discharged from the pump to the purge passage on the control valve side in a situation where the control valve is in the open state while the control valve continuously switches between the closed state and the open state according to the duty cycle, may be supplied to the intake passage. In a case where a driving duration of the pump since the pump started being driven is less than a predetermined duration, the control unit may switch the control valve according to a second upper limit value of the duty cycle or less, the second upper limit value being less than a first upper limit value of the duty cycle that is used when the driving duration of the pump since the pump started being driven is equal to or more than the predetermined duration; the acquiring unit may acquire the characteristic value in a situation where the control valve is in the closed state while the control valve continuously switches according to the duty cycle; and the estimating unit may estimate the flow rate of the gas discharged from the pump to the purge passage on the control valve side by using the acquired characteristic value. In the case where the driving duration of the pump since the pump started being driven is less than the predetermined duration, the rotational speed of the pump is not stabilized, thus the flow rate of the purge gas discharged from the pump to the purge passage on the control valve side changes. In this case, a duration in which the control valve is in the closed state is elongated by driving the control valve according to the second upper limit value of the duty cycle or less, which is lower than the first upper limit value of the duty cycle. By doing so, the characteristic value may more easily be acquired. As a result, the flow rate of the purge gas while the rotational speed of the pump is still unstable may be estimated by using the characteristic value.

The art disclosed herein relates to another evaporated fuel processing device. This evaporated fuel processing device may comprise: a canister configured to store evaporated fuel; a control valve disposed on a purge passage communicating the canister and an intake passage of an engine and configured to switch between a closed state and an open state, the closed state being a state of closing the purge passage and the open state being a state of opening the purge passage; a pump disposed on the purge passage between the canister and the control valve; an acquiring unit configured to acquire a pressure difference between a pressure in the purge passage on a control valve side of the pump and a pressure in the purge passage on a canister side of the pump in a situation where the control valve is in the closed state and the pump pressurizes gas in the purge passage on the control valve side; and an adjusting unit configured to adjust a flow rate of the gas that the pump discharges to the purge passage on the control valve side in a situation where the control valve is in the open state, by using the acquired pressure difference.

When the pump is driven in the situation where the control valve is in the closed state, the gas between the pump and the control valve is pressurized by the pump. If there is a variation in the flow rate of the gas discharged from the pump, the pressure difference between upstream and downstream sides relative to the pump in the situation where the control valve is in the closed state and the pump pressurizes the gas in the purge passage on the control valve side changes in correlation with the aforementioned variation in the flow rate. Due to this, the flow rate of the gas which the pump discharges to the purge passage on the control valve side in the situation where the control valve is in the open state may be adjusted by using this pressure difference between the upstream and downstream sides relative to the pump. As a result, the flow rate of the gas discharged from the pump may suitably be controlled.

The adjusting unit may store in advance a standard pressure difference for the pressure difference between the pressure in the purge passage on the control valve side and the pressure in the purge passage on the canister side in the situation where the control valve is in the closed state and the pump pressurizes gas in the purge passage on the control valve side. The adjusting unit may be configured to adjust the flow rate of the gas that the pump discharges to the purge passage on the control valve side in a situation where the control valve is in the open state, by adjusting a rotational speed of the pump such that the acquired pressure difference becomes identical to the standard pressure difference. According to this configuration, influence of the individual difference of the pump may be suppressed by adjusting the rotational speed of the pump so that the pressure difference between the upstream and downstream sides relative to the pump becomes identical to the standard pressure difference. Due to this, the flow rate of the gas discharged from the pump may be adjusted to a predetermined flow rate.

The adjusting unit may store in advance pump characteristic data for each of plural evaporated fuel concentrations of the gas, each of the pump characteristic data indicating a relationship between the flow rate of the gas from the pump and the pressure difference that varies according to a divergence of the control valve. Each of the pump characteristic data may include the pressure difference in the situation where the control valve is in the closed state and the pump pressurizes the gas in the purge passage on the control valve side. The gas may not flow out from the pump in the situation where the control valve is in the closed state and the pump pressurizes the gas in the purge passage on the control valve side. The adjusting unit may be configured to: specify one pump characteristic data from the plurality of pump characteristic data by using the pressure difference in the situation where the control valve is in the closed state and the pump pressurizes the gas in the purge passage on the control valve side; and adjust the flow rate of the gas discharged from the pump to the purge passage on the control valve side by using the specified one pump characteristic data to adjust the divergence of the control valve. According to this configuration, the pump characteristic data of the pump actually mounted in the evaporated fuel processing device may be specified. As a result, the flow rate of the gas discharged from the pump may suitably be adjusted by using the specified pump characteristic data to adjust the divergence of the control valve.

DETAILED DESCRIPTION

First Embodiment

Figure 1:
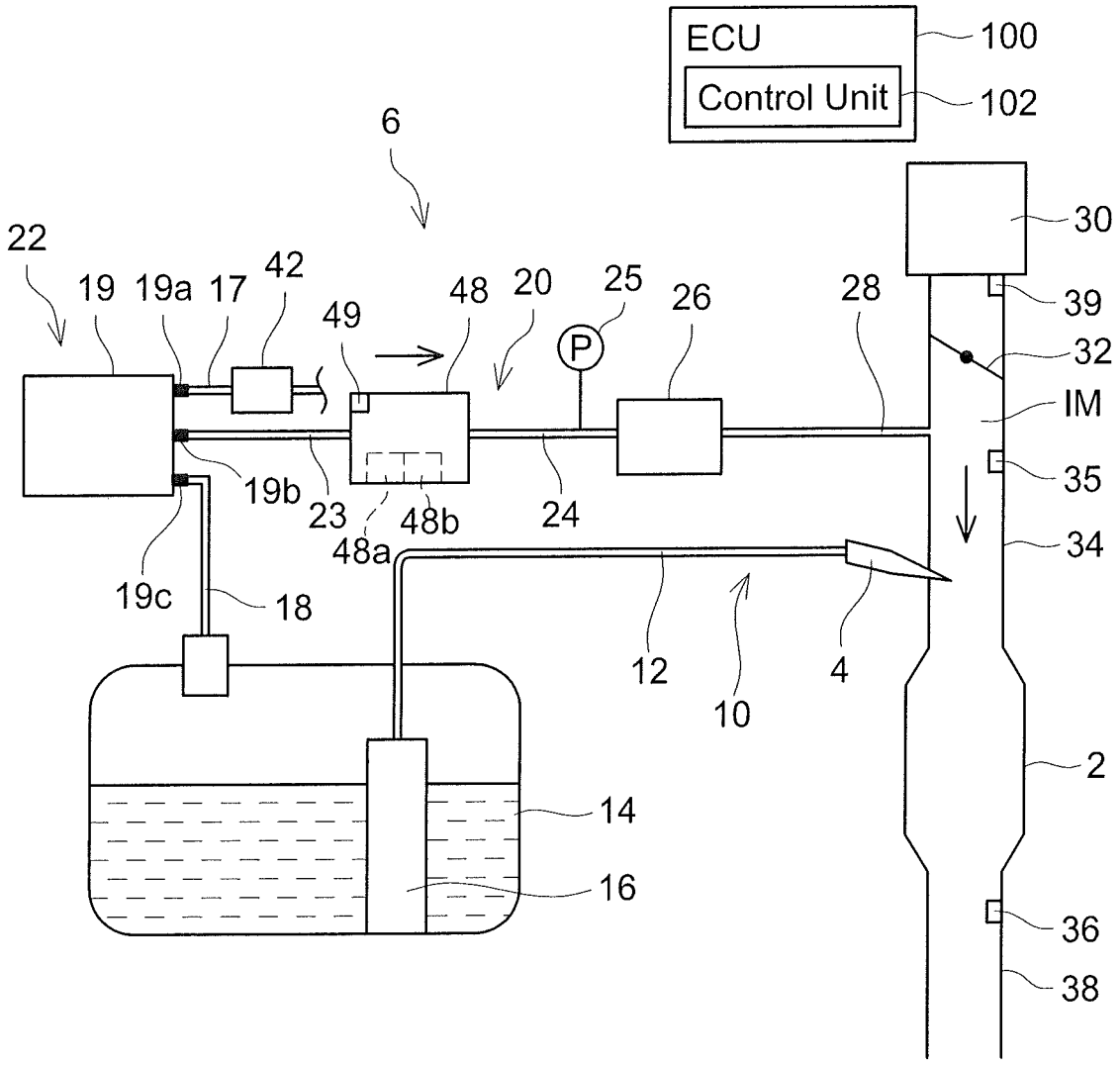
FIG. 1 shows an overview of a fuel supply system of a vehicle according to a first embodiment.

A fuel supply system 6 provided with an evaporated fuel processing device 20 will be described with reference to FIG. 1. The fuel supply system 6 is mounted on a vehicle such as an automobile, and is provided with a main supply passage 10 for supplying fuel stored in a fuel tank 14 to an engine 2 and an evaporated fuel passage 22 for supplying evaporated fuel generated in the fuel tank 14 to the engine 2.

The main supply passage 10 is provided with a fuel pump unit 16, a supply passage 12, and an injector 4. The fuel pump unit 16 is provided with a fuel pump, a pressure regulator, a control circuit, and the like. The fuel pump unit 16 controls the fuel pump according to a signal supplied from an ECU 100. The fuel pump boosts pressure of the fuel in the fuel tank 14 and discharges the same. The pressure of the fuel discharged from the fuel pump is regulated by the pressure regulator, and the fuel is supplied from the fuel pump unit 16 to the supply passage 12. The supply passage 12 is connected to the fuel pump unit 16 and the injector 4. The fuel supplied to the supply passage 12 passes through the supply passage 12 and reaches the injector 4. The injector 4 includes a valve (not shown) of which divergence is controlled by the ECU 100. When the valve of the injector 4 is opened, the fuel in the supply passage 12 is supplied to an intake passage 34 connected to the engine 2.

The intake passage 34 is connected to an air cleaner 30. The air cleaner 30 is provided with a filter that removes foreign particles in air that flows into the intake passage 34.

A throttle valve 32 is provided in the intake passage 34 between the engine 2 and the air cleaner 30. When the throttle valve 32 opens, air is suctioned from the air cleaner 30 toward the engine 2 in an up-down direction as indicated by an arrow in FIG. 1. The ECU 100 adjusts a divergence of the throttle valve 32 to change an opening area of the intake passage 34, and thereby adjusts a quantity of air flowing into the engine 2. The throttle valve 32 is provided on an air cleaner 30 side than the injector 4.

An air flowmeter 39 is disposed in the intake passage 34 between the air cleaner 30 and the throttle valve 32. The air flowmeter 39 measures a gas quantity of gas flowing in the intake passage 34 through the air cleaner 30.

Gas combusted in the engine 2 flows in an exhaust passage 38 and is discharged therefrom. An air-fuel ratio sensor 36 is disposed in the exhaust passage 38. The air-fuel ratio sensor 36 detects an air-fuel ratio in the exhaust passage 38. When acquiring the air-fuel ratio from the air-fuel ratio sensor 36, the ECU 100 estimates an air-fuel ratio of gas supplied to the engine 2.

The evaporated fuel passage 22 is disposed parallel to the main supply passage 10. The evaporated fuel passage 22 is a passage through which evaporated fuel generated in the fuel tank 14 flows when it moves from the fuel tank 14 to the intake passage 34 through a canister 19. As will be described later, the evaporated fuel is mixed with air in the canister 19. The mixed gas of the evaporated fuel and the air generated in the canister 19 is termed purge gas. The evaporated fuel processing device 20 is provided on the evaporated fuel passage 22. The evaporated fuel processing device 20 includes the canister 19, a pressure sensor 25, a control valve 26, a pump 48, and a control unit 102 of the ECU 100.

The fuel tank 14 and the canister 19 are connected by a tank passage 18. The canister 19 is connected to the pump 48 via a purge passage 23. The pump 48 is connected to the control valve 26 via a purge passage 24. The control valve 26 is connected to the intake passage 34 via a communication passage 28. The purge passages 23, 24 are connected to the intake passage 34 between the injector 4 and the throttle valve 32 via the control valve 26 and the communication passage 28. An intake manifold IM is disposed at a position in the intake passage 34 where the communication passage 28 is connected.

The control valve 26 is disposed between the communication passage 28 and the purge passage 24. The control valve 26 is a solenoid valve controlled by the control unit 102, and is controlled by the control unit 102 to switch between an open state of being opened and a closed state of being closed. The control unit 102 executes a duty cycle control to continuously switch the control valve 26 between the open state and the closed state according to a duty cycle determined based on the air-fuel ratio and the like. In the open state, the purge passage 24 opens, by which the canister 19 and the intake passage 34 are communicated. In the closed state, the purge passage 24 closes, by which communication between the canister 19 and the intake passage 34 is cut off on the purge passage 24. The duty cycle indicates a ratio of duration of the open state to duration of one set of the open state and the closed state that continuously take place while the open state and the closed state are continuously switched. The control valve 26 adjusts the duty cycle (that is, a length of the duration of the open state) to adjust a flow rate (g/min) of the gas containing the evaporated fuel (that is, the purge gas). The duty cycle is an example of "divergence" of the control valve 26.

The control valve 26 may be a stepping motor-type control valve configured to adjust its divergence (in other words, a flow passage area for the purge gas).

The pump 48 is disposed between the purge passage 24 and the purge passage 23. The pump 48 is a so-called vortex pump (which may be termed a cascade pump or a Wesco pump), or a centrifugal pump. The pump 48 is controlled by the control unit 102. When the pump 48 is driven, the purge gas is suctioned to the pump 48 from the canister 19 through the purge passage 23. The purge gas suctioned into the pump 48 is boosted in the pump 48, and is discharged to the purge passage 24. The purge gas discharged to the purge passage 24 is supplied to the intake passage 34 through the purge passage 24, the control valve 26, and the communication passage 28. A temperature sensor 49 for detecting a temperature in the pump 48 is attached to the pump 48. In a variant, the temperature sensor 49 may be disposed on the purge passage 24 in a vicinity of a discharge end of the pump 48. A voltage sensor 48*a* and a current sensor 48*b* indicated by broken lines in FIG. 1 are used in a fifth embodiment, and may not be provided in the present embodiment.

The pressure sensor 25 is disposed on the purge passage 24. The pressure sensor 25 detects a pressure in the purge passage 24 and supplies a measured value thereof to the control unit 102.

The canister 19 is connected to the pump 48 via the purge passage 23. The canister 19 includes an open-air port 19*a*, a purge port 19*b*, and a tank port 19*c*. The open-air port 19*a* communicates with open air via an open air passage 17 and an air filter 42. The open air may pass through the air filter, and may flow into the canister 19 from the open-air port 19*a* through the open air passage 17. In such an occasion, foreign particles in the open air are prevented from entering the canister 19 by the air filter 42.

The purge port 19*b* is connected to the purge passage 23. The tank port 19*c* is connected to the fuel tank 14 via the tank passage 18.

An activated charcoal (not shown) is housed in the canister 19. The activated charcoal adsorbs the evaporated fuel from the gas flowing into the canister 19 from the fuel tank 14 through the tank passage 18 and the tank port 19*c*. The gas after the evaporated fuel was adsorbed is discharged to the open air through the open-air port 19*a* and the open air passage 17. The canister 19 can suppress the evaporated fuel in the fuel tank 14 from being discharged to the open air. The evaporated fuel adsorbed by the activated charcoal is supplied to the purge passage 23 from the purge port 19*b*.

The control unit 102 is connected to the pump 48 and the control valve 26. The control unit 102 includes a CPU and a memory such as a ROM and a RAM. The control unit 102 controls the pump 48 and the control valve 26.

Next, an operation of the evaporated fuel processing device 20 will be described. When a purge condition is satisfied while the engine 2 is driven, the control unit 102 executes duty cycle control on the control valve 26 to execute a purge process of supplying the purge gas to the engine 2. When the purge process is executed, the purge gas is supplied in a left-to-right direction indicated by an arrow in FIG. 1. The purge condition is a condition that is satisfied in a case where the purge process of supplying the purge gas to the engine 2 is to be executed, and is a condition that is preset by a manufacturer in the control unit 102 according to a cooling water temperature for the engine 2 and an evaporated fuel concentration of the purge gas (hereinbelow termed "purge concentration"). The control unit 102 monitors whether or not the purge condition is satisfied at all times while the engine 2 is driven. The control unit 102 controls the duty cycle of the control valve 26 based on the purge gas concentration and a measured value of the air flowmeter 39. Due to this, the purge gas that was adsorbed in the canister 19 is introduced to the engine 2.

In a case of executing the purge process, the control unit 102 drives the pump 48 and supplies the purge gas to the intake passage 34. As a result, even in a case where a negative pressure in the intake passage 34 is small, the purge gas can be supplied. The control unit 102 may switch the pump 48 between a driven state and a stopped state during the purge process according to a situation of the purge gas supply.

The ECU 100 controls the throttle valve 32. Further, the ECU 100 also controls an injected fuel quantity by the injector 4. Specifically, the ECU 100 controls the injected fuel quantity by controlling duration of a valve open state of the injector 4. When the engine 2 is driven, the ECU 100 calculates a fuel injecting duration (that is, the duration of valve open state of the injector 4) during which the fuel is injected from the injector 4 to the engine 2, per unit time. The fuel injecting duration corrects a reference injecting duration that is specified in advance by experiments in order to maintain the air-fuel ratio at a target air-fuel ratio (such as an ideal air-fuel ratio). Further, the ECU 100 corrects the injected fuel quantity based on the flow rate of the purge gas and the purge concentration.

Figure 14:
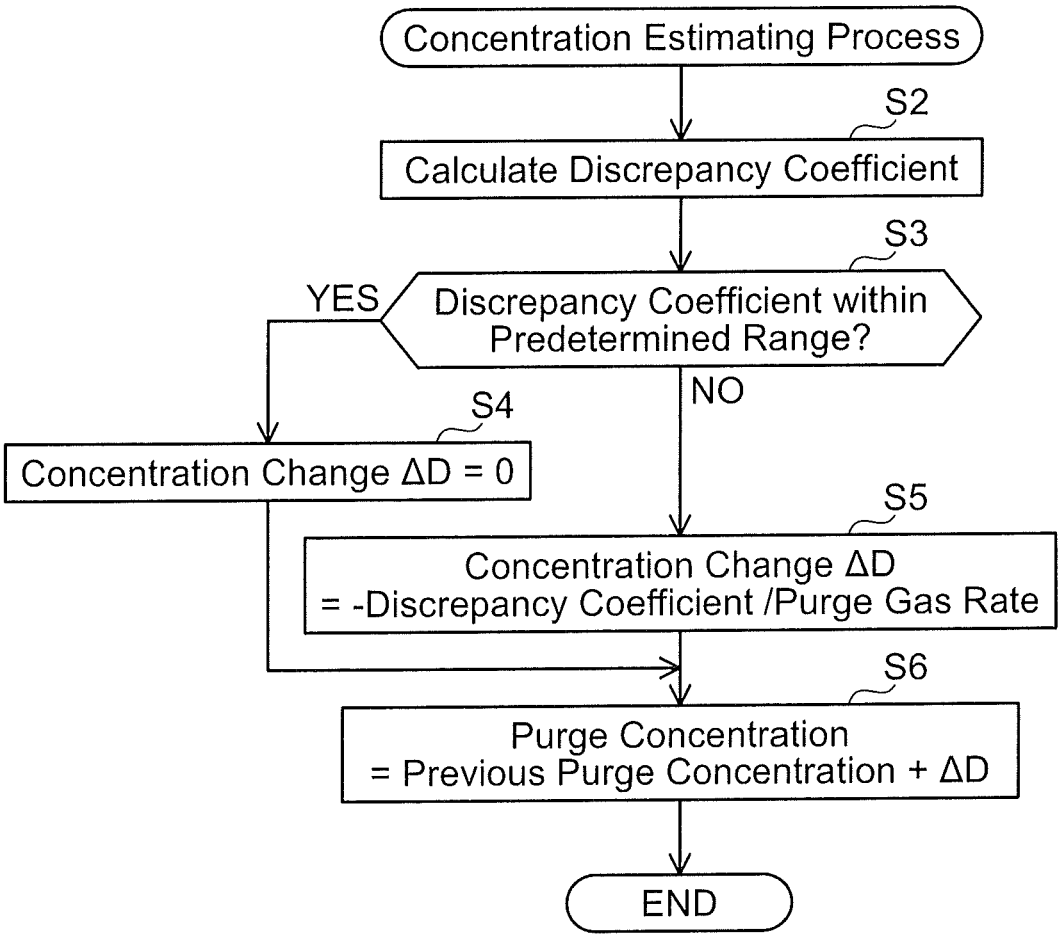
FIG. 14 shows a flowchart of a concentration estimating process.

The ECU 100 executes a concentration estimating process of estimating the purge concentration by using the air-fuel ratio detected by the air-fuel ratio sensor 36. The concentration estimating process is executed repeatedly while the purge process is executed. As shown in FIG. 14, in the concentration estimating process, the ECU 100 firstly calculates in S2 a discrepancy coefficient that indicates how much the detected air-fuel ratio is discrepant from a preset reference air-fuel ratio (such as the ideal air-fuel ratio (=14.7)). Specifically, the control unit 102 calculates the discrepancy coefficient by subtracting the reference air-fuel ratio from the detected air-fuel ratio, dividing a result thereof by the reference air-fuel ratio, and then multiplying a quotient thereof by 100.

The air-fuel ratio becomes smaller with a higher ratio of the fuel in the gas supplied to the engine 2. In a case where the air-fuel ratio is richer than the reference air-fuel ratio, the ratio of the fuel is high and the detected air-fuel ratio is smaller than the reference air-fuel ratio. Due to this, the discrepancy coefficient is a negative value. On the other hand, in a case where the air-fuel ratio is leaner than the reference air-fuel ratio, the ratio of the fuel is low and the detected air-fuel ratio is larger than the reference air-fuel ratio. Due to this, the discrepancy coefficient is a positive value.

Next, in S3, the ECU 100 determines whether or not the discrepancy coefficient is within a predetermined range. The predetermined range is a range indicating that the purge concentration has not changed since a previous concentration estimating process was executed, that is, a range which can be considered a detection error of the air-fuel ratio sensor 36, and the range may be ±5%, for example. In a case where the discrepancy coefficient is within the predetermined range (YES in S3), the ECU 100 determines that concentration change ΔD=0 in S4, and proceeds to S6. On the other hand, in a case where the discrepancy coefficient is outside the predetermined range (NO in S3), the ECU 100 calculates concentration change ΔD=—discrepancy coefficient/purge gas rate in S5, and proceeds to S6.

The purge gas rate indicates a ratio of the purge gas in a total quantity of suctioned gas that is suctioned to the engine 2. The suctioned gas includes the air suctioned through the air cleaner 30 and the intake passage 34 and the purge gas supplied from the evaporated fuel processing device 20 in the purge process. An air quantity suctioned through the intake passage 34 is detected by the air flowmeter 39. The flow rate of the purge gas is specified by using a variation coefficient α to be described later. The ECU 100 calculates the purge gas rate as: purge gas rate=purge gas flow rate/(air quantity+purge gas flow rate)×100.

In S6, the ECU 100 estimates the purge concentration by adding the concentration change ΔD specified in S4 or S5 to the purge concentration that was estimated in S6 that was previously executed. In a case where the purge concentration estimated in previously-executed S6 does not exist, it is determined that the purge concentration estimated in previously-executed S6 is 0. Further, in a case where a negative value is calculated in S6, the purge concentration is estimated as 0%. The estimated purge concentration is stored in the ECU 100 and is updated by the concentration estimating process while an ignition switch is on. When the ignition switch is switched from on to off, the ECU 100 erases the estimated purge concentration.

In a variant, the ECU 100 may estimate the purge concentration by using a concentration-flow rate data map indicating a relationship between purge concentration and integrated quantity of the purge gas flow rate, which is specified in advance by experiments and stored in the ECU 100. Further, the ECU 100 may correct the concentration-flow rate data map according to the discrepancy in the air-fuel ratio.

Figure 17:
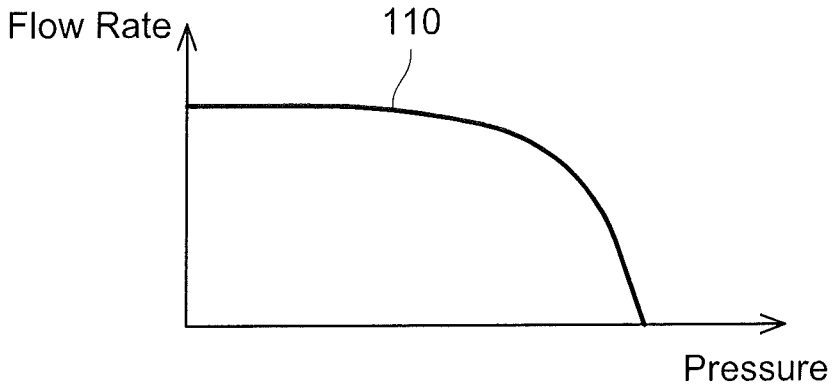
FIG. 17 shows standard flow rate characteristic data.

The purge gas flow rate is specified by the control unit 102. Specifically, as shown in FIG. 17, the control unit 102 stores standard flow rate characteristic data 110 (hereinbelow simply termed "data 110") that indicates a relationship between flow rate of the purge gas discharged from the pump 48 and pressure in the intake passage 34 (that is, pressure in the intake manifold IM) under a state where the control valve 26 is in a fully open state (that is, duty cycle=1.0) and the pump 48 is driven at a predetermined rotational speed X1 (such as 12000 rpm) in the purge process. In the data 110 of FIG. 17, a vertical axis indicates the flow rate of the purge gas from the pump 48 and a horizontal axis indicates the pressure in the intake manifold IM. The pressure in the intake manifold IM is detected by a pressure sensor 35 disposed in the intake manifold IM. The data 110 is specified in advance by experiments, and is stored in the control unit 102.

The control unit 102 calculates the purge gas flow rate from the data 110 by using the pressure in the intake manifold IM, a rotational speed X2 of the pump 48, and a duty cycle Y. Specifically, the control unit 102 specifies a flow rate Z corresponding to the pressure in the intake manifold IM from the data 110. Then, the control unit 102 multiplies the specified flow rate Z by a ratio X2/X1 of the rotational speed of the pump 48 and the duty cycle Y of the control valve 26 to calculate the purge gas flow rate.

The data 110 is specified by the experiments that were carried out by using one or more pumps selected from among a large number of manufactured pumps. There is a variation among the large number of pumps caused by individual differences, such as manufacturing errors. Further, a variation caused by deterioration of the pump 48 over time may also occur. As a result, there is a possibility that the relationship between the purge gas flow rate from the pump 48 and the pressure in the intake manifold IM may be discrepant from the relationship between the purge gas flow rate and the pressure in the intake manifold IM indicated by the data 110.

The control unit 102 executes a pump determination process of specifying the relationship between the purge gas flow rate unique to the pump 48 and the pressure in the intake manifold IM as well as determining that the pump 48 is not operating normally. The pump determination process is executed regularly or irregularly while the purge process is executed.

Figure 2:
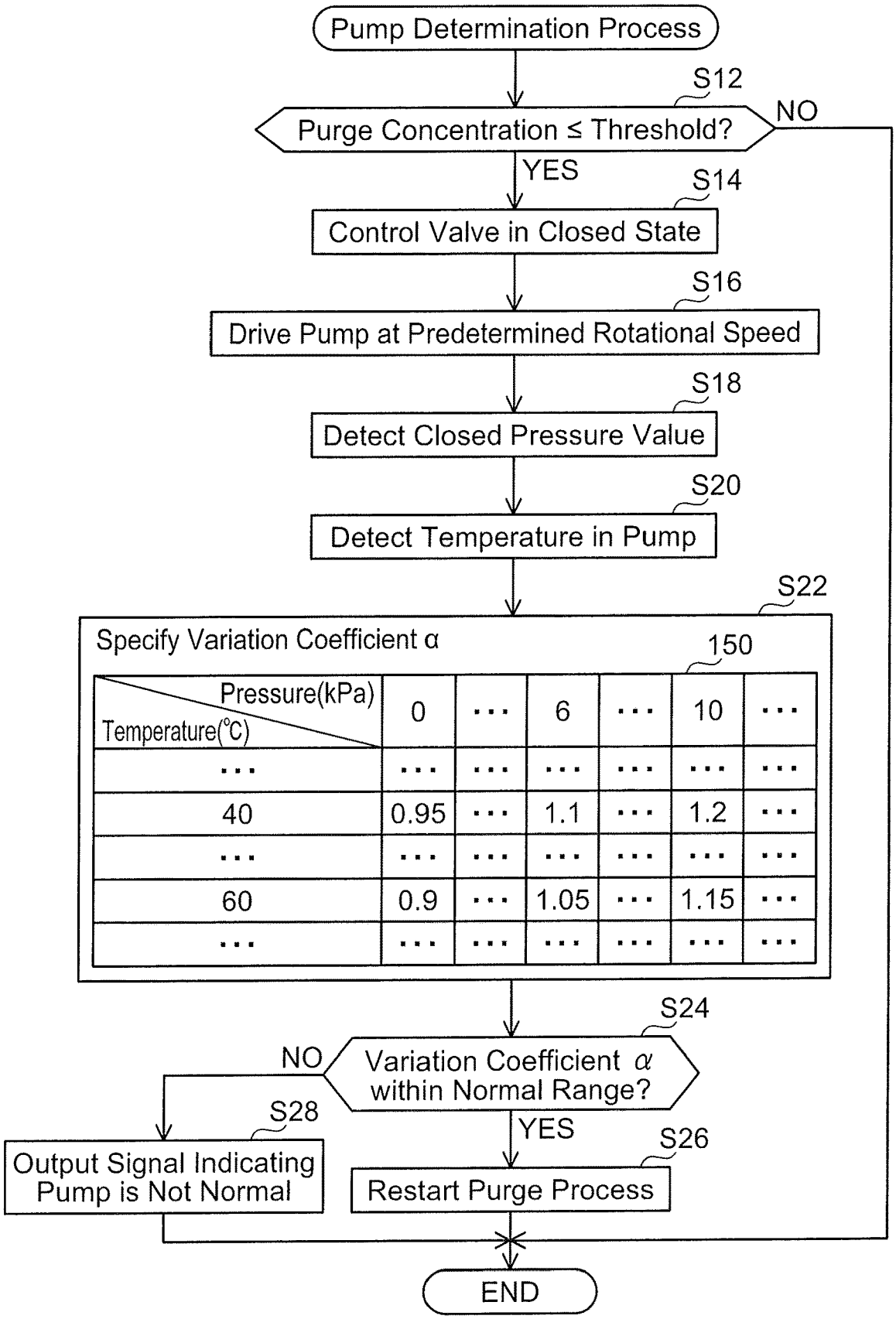
FIG. 2 shows a flowchart of a pump determination process according to the first embodiment.

As shown in FIG. 2, in the pump determination process, the control unit 102 firstly determines in S12 whether or not the purge concentration estimated in the concentration estimating process is equal to or less than a threshold (such as 5%). In a case where the purge concentration is higher than the threshold (NO in S12), the pump determination process is terminated. On the other hand, in a case where the purge concentration is equal to or less than the threshold (YES in S12), the control unit 102 maintains the control valve 26, which is under the duty cycle control, in the closed state in S14. Due to this, the purge process is stopped. In the pump determination process, a variation coefficient α is specified by using a data map 150 to be described later, and for specifying the data map 150, experiments are carried out by using purge gas with a relatively low purge concentration. When the purge concentration is relatively high, it is difficult to specify the variation coefficient α accurately by using the data map 150 to be described later. Due to this, processes from S14 are not executed in the case where the purge concentration is higher than the threshold (NO in S12), and the pump determination process is terminated in a state of continuing the purge process.

Next, in S16, the control unit 102 drives the pump 48 at a predetermined rotational speed (such as 12,000 rpm). In a case where the pump 48 is already driven at the predetermined rotational speed, the pump 48 is maintained to be driven in S16. Next, in S18, the control unit 102 uses the pressure sensor 25 to detect a pressure in the purge passage 24. In S18, the pressure in the purge passage 24 is detected in a situation where the control valve 26 is in the closed state and the pump 48 is driven at the predetermined rotational speed to pressurize the gas in the purge passage 24 on a control valve 26 side. Hereinbelow, the pressure detected in S18 will be termed a closed pressure value.

Next, in S20, the control unit 102 uses the temperature sensor 49 to detect a temperature in the pump 48. Then, in S22, the control unit 102 specifies a variation coefficient α. Specifically, the control unit 102 stores the data map 150 that indicates a correlation of pressure-temperature-variation coefficient.

The data map 150 is specified by experiments and is stored in advance. In the experiments, firstly, a plurality of pumps having different pump characteristics is prepared. Then, the closed pressure value of the purge passage 24 is detected in the situation where the control valve 26 is in the closed state and the pump 48 is driven at the predetermined rotational speed X1 to pressurize the gas in the purge passage 24 on the control valve 26 side, for each of the plurality of pumps at various temperatures in the plurality of pumps. In the experiments, purge gas with a relatively low purge concentration (such as 3%) is used. Then, the data map 150 is specified by calculating a discrepancy between the flow rate in a situation where the control valve 26 is in the fully open state and the pump is driven at the predetermined rotational speed X1 (hereinbelow termed "measured flow rate") and the flow rate indicated by the data 110 (hereinbelow termed "standard flow rate"), that is, by calculating measured flow rate/standard flow rate=variation coefficient α, for each of the plurality of pumps. The data map 150 records the variation coefficients α that correspond to the closed pressure values and the temperatures of the pump 48. The data map 150 indicates " . . . " for simplicity, however, numerical values are actually recorded there. Further, ranges and intervals of the closed pressure values and the temperatures recorded in the data map 150 may suitably be set by taking into account a usage environment of the evaporated fuel processing device 20.

The control unit 102 specifies the variation coefficient α corresponding to the closed pressure value detected in S18 and the temperature in the pump 48 detected in S20 from the data map 150.

Next, in S24, a determination is made on whether or not the variation coefficient α specified in S22 is within a normal range (such as 0.8 to 1.2). The normal range is a range indicating a variation at a degree by which the pump 48 can be determined as operating normally, and is set so that a pump that is not discharging sufficient purge gas due to deterioration and a pump that is not controlled appropriately due to a failure in its electrical system, and the like would be outside the normal range. The plurality of pumps used in the experiments for specifying the data map 150 includes pumps that are not operating normally. Due to this, in S22, the control unit 102 specifies the variation coefficients α of the pumps that are not operating normally.

In a case where the variation coefficient α is in the normal range (YES in S24), the control unit 102 starts in S26 the duty cycle control on the control valve 26 and drives the pump 48 at the rotational speed that was used before the rotational speed have been changed in S16, that is, starts the purge process, and terminates the pump determination process. On the other hand, in a case where the variation coefficient α is not in the normal range (NO in S24), the control unit 102 determines in S28 that the pump 48 is not operating normally, sends a signal indicating this determination result to a display device of the vehicle, and terminates the pump determination process. When receiving the signal from the control unit 102, the display device displays information indicating that the pump 48 is not operating normally. Due to this, a driver can acknowledge that the pump 48 is not operating normally. In this case, the pump determination process is terminated without restarting the purge process.

In a variant, the data map 150 may record only the variation coefficients α corresponding to the pump operating normally. In this case, the control unit 102 may proceed to S28 in a case where the variation coefficient α is not specified in S22, and may proceed to S26 in the case where the variation coefficient is specified.

The control unit 102 stores the variation coefficient α. The control unit 102 updates the variation coefficient α each time the pump determination process is executed. In a case where the variation coefficient α is stored, the control unit 102 specifies a corrected purge gas flow rate by multiplying the purge gas flow rate calculated by using the pressure in the intake manifold IM, the rotational speed X2 of the pump 48, and the duty cycle Y by the variation coefficient α. The purge gas flow rate specified here is the flow rate per minute of the purge gas supplied to the intake passage 34 through the control valve 26 when the control valve 26 is in the open state during the duty cycle control of the control valve 26, that is, when the control valve 26 is in the open state during the purge process, and this flow rate is expressed by a unit of g/min.

When the pump 48 is driven while the control valve 26 is in the closed state, the purge passage 24 is pressurized by the pump 48. In a case where there is a discrepancy in the flow rate of the purge gas discharged from the pump 48 from the standard flow rate, the closed pressure value, which is a characteristic value of the pump 48, changes in correlation to this discrepancy. Due to this, the flow rate of the purge gas which the pump 48 discharges to the purge passage 24 in the situation where the control valve 26 is in the open state while being controlled based on the duty cycle control, that is, the flow rate of the purge gas supplied to the intake passage 34 during the purge process can be estimated by using this closed pressure value. According to this configuration, the flow rate of the purge gas discharged from the pump 48 can be estimated by using the characteristic of the pump 48 that is actually mounted in the evaporated fuel processing device 20.

Further, the closed pressure value is detected by disposing the pressure sensor 25 on the purge passage 24. Due to this, the characteristic value of the pump 48 can easily be obtained.

Second Embodiment

Figure 3:
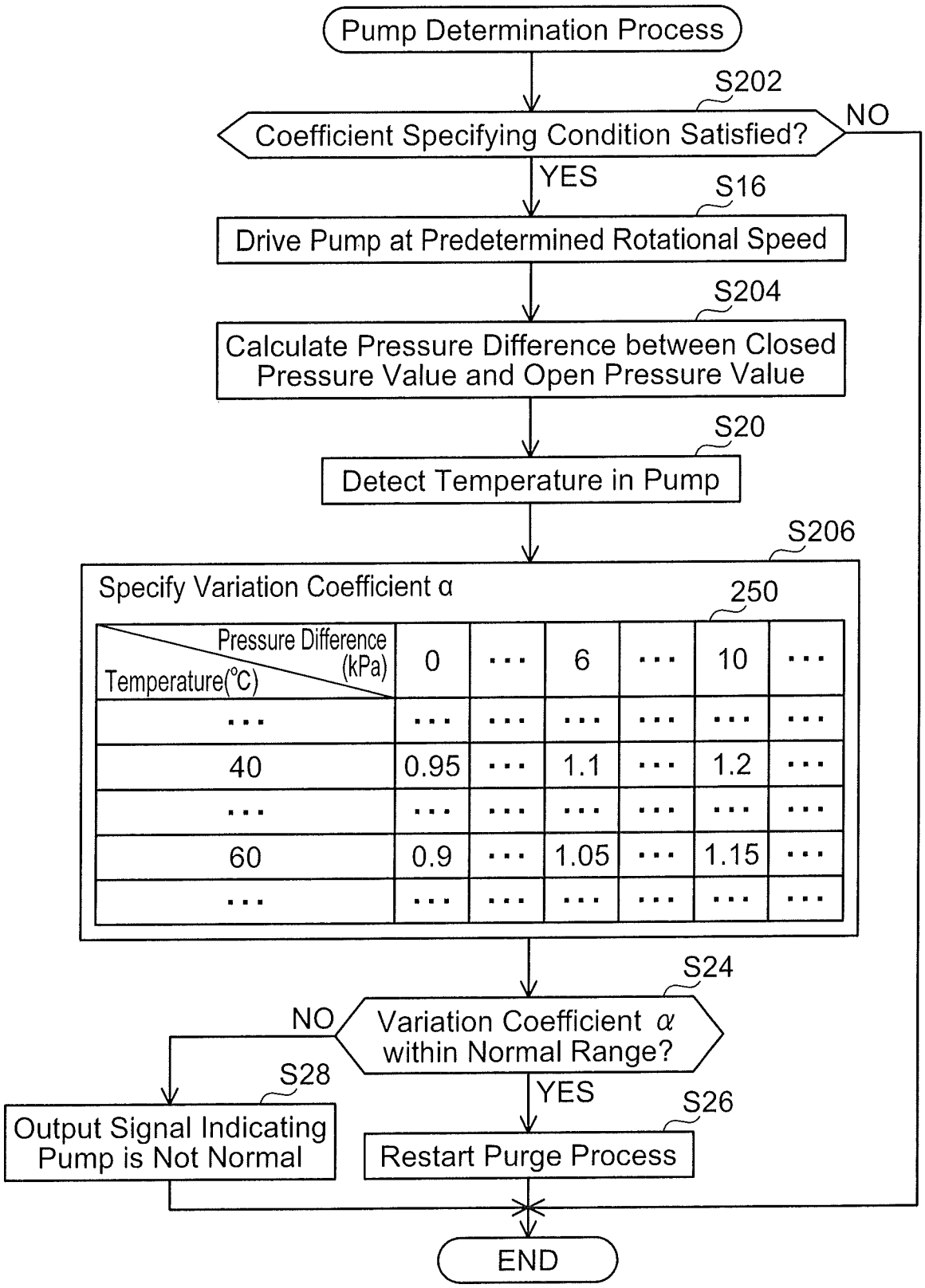
FIG. 3 shows a flowchart of a pump determination process according to a second embodiment.

Differences from the first embodiment will be described. In this embodiment, contents of the pump determination process are different. In the present embodiment, the variation coefficient is specified while the purge process is executed. Specifically, the pump determination process shown in FIG. 3 is executed.

The pump determination process is started when the vehicle is started (for example, when the ignition switch is switched from off to on). Firstly in S202, the control unit 102 determines whether or not a coefficient specifying condition is satisfied. The coefficient specifying condition is a condition for suitably specifying the variation coefficient, and specifically, the coefficient specifying condition is determined as being satisfied when following conditions (I) to (III) are satisfied. The coefficient specifying condition includes: (I) the purge process is being executed, (II) the duty cycle of the control valve 26 is equal to or less than a predetermined duty cycle (such as 60%), and (III) the purge concentration is equal to or less than the threshold (such as 5%). The condition (II) is set because it is difficult to detect the closed pressure value by using the pressure sensor 25 in the valve closed duration in a case where the duty cycle is large, that is, in a case where the valve opened duration is long as compared to the valve closed duration.

In a case where the coefficient specifying condition is not satisfied (NO in S202), the pump determination process is terminated. On the other hand, in a case where the coefficient specifying condition is satisfied (YES in S202), the control unit 102 executes the process of S16, that is, drives the pump 48 at the predetermined rotational speed. Next, in S204, the control unit 102 uses the pressure sensor 25 to detect the closed pressure value in the valve closed duration (that is, in the situation where the control valve 26 is in the closed state and the pump 48 pressurizes the purge gas in the purge passage 24) and an open pressure value in the valve open duration (that is, in the situation where the control valve 26 is in the open state and the pump 48 discharges the purge gas to the purge passage 24) while the control valve 26 is controlled based on the duty cycle control, and calculates a pressure difference between the closed pressure value and the open pressure value.

Figure 4:
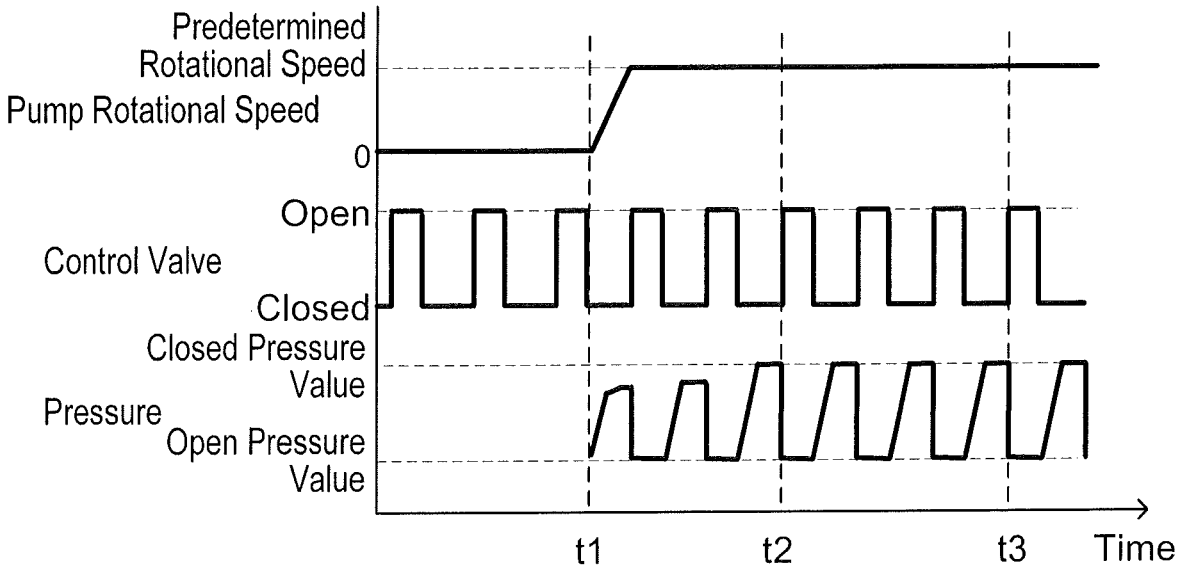
FIG. 4 shows a time chart indicating operation of a control valve and detected value of a pressure sensor according to the second embodiment.

FIG. 4 shows the rotational speed of the pump 48, opening and closing timings of the control valve 26, and changes in the pressure when the pump 48 is driven in S16. Immediately after the pump 48 starts to be driven (that is, time t1 to time t2), the closed pressure value changes each time the control valve 26 is switched from the open state to the closed state. In S204, the control unit 102 causes the closed pressure value and the open pressure value to be detected after the switch of the control valve 26 from the open state to the closed state has taken place a preset number of times (such as three times) (that is, time t2) after S16 (that is, time t1. Further, during when the control valve 26 is controlled based on the duty cycle control, the closed pressure value changes slightly even after the switch has taken place the preset number of times (such as three times). Due to this, the control unit 102 may detect a pressure difference plural times (time t2 to time t3) and may calculate an average thereof as the pressure difference, or may calculate a difference between an average of the closed pressure values and an average of the open pressure values as the pressure difference.

Next, the control unit 102 executes the process of S20, that is, detects a temperature in the pump 48. Then, in S206, the control unit 102 specifies a variation coefficient $\alpha$. Specifically, the control unit 102 stores a data map 250 indicating a correlation of pressure difference-temperature-variation coefficient.

The data map 250 is specified by experiments and is stored in advance, similarly to the data map 150. In the experiments, closed pressure values and open pressure values are detected at various temperatures in a plurality of pumps, instead of the closed pressure values in the case with the experiments for the data map 150. Then, the data map 250 is specified by calculating a discrepancy from the standard flow rate indicated by the data 110 of the measured flow rate in the situation where the control valve 26 is in the fully open state and the pump is driven at the predetermined rotational speed X1, that is, by calculating measured flow rate/standard flow rate=variation coefficient $\alpha$, for each of the plurality of pumps.

The control unit 102 specifies a variation coefficient $\alpha$ corresponding to the pressure difference detected in S204 and the temperature in the pump 48 detected in S20 from the data map 250. Then, it executes the processes of S24 to S28 and terminates the pump determination process.

According to this embodiment as well, the flow rate of the purge gas discharged from the pump 48 can be estimated by using the characteristic of the pump 48 that is actually mounted in the evaporated fuel processing device 20, that is, the closed pressure value, the open pressure value, and the temperature in the pump 48.

Further, in the present embodiment, the flow rate of the purge gas discharged from the pump 48 can be estimated while the purge process is executed. As a result, the rotational speed of the pump 48 and the duty cycle can be determined by using the purge gas flow rate estimated during the purge process. According to this configuration, the variation coefficient $\alpha$ can be specified without stopping the purge process.

Third Embodiment

Figure 5:
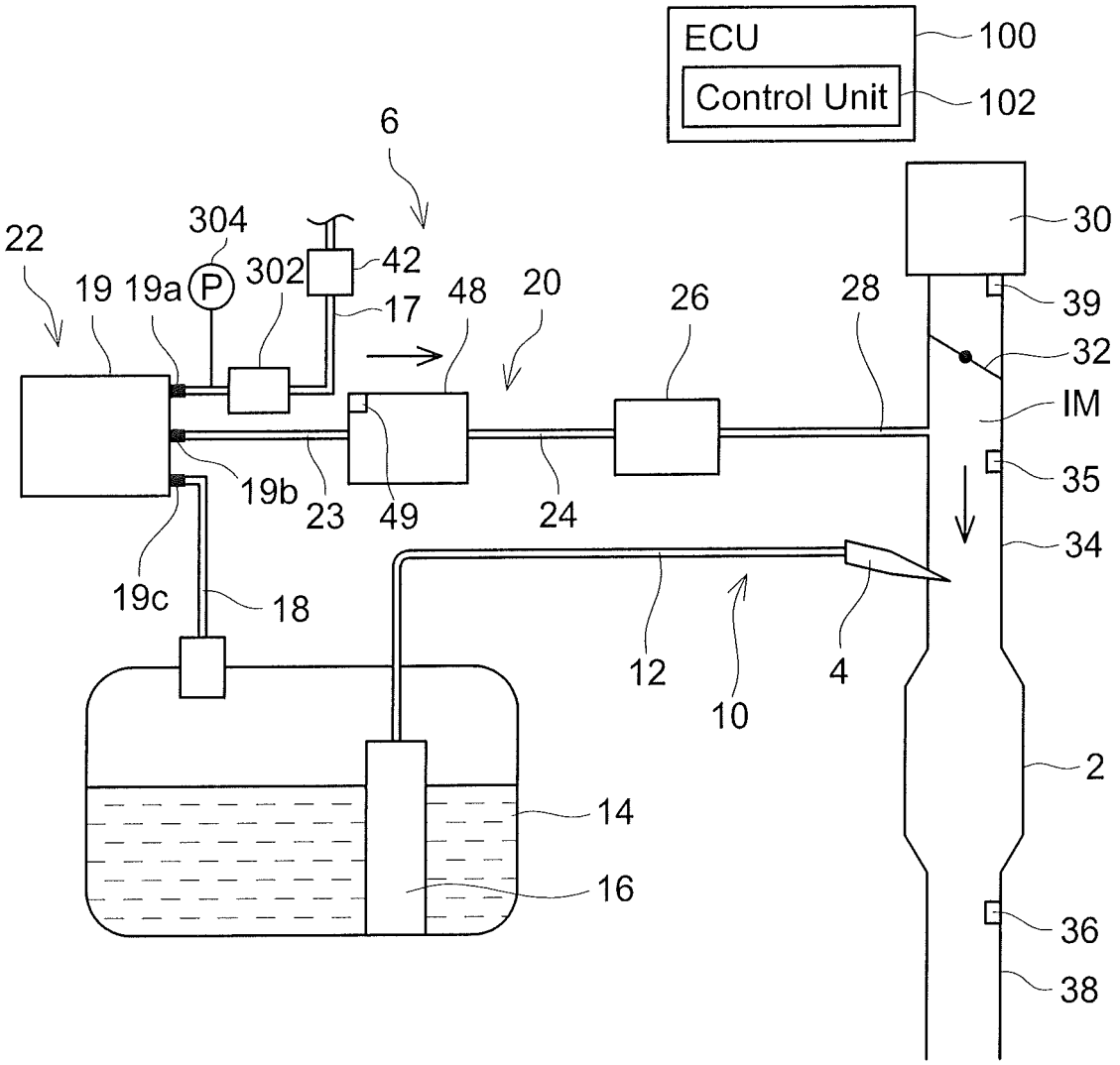
FIG. 5 shows an overview of a fuel supply system of a vehicle according to a third embodiment.

Differences from the first embodiment will be described. As shown in FIG. 5, the evaporated fuel processing device 20 according to the present embodiment includes an open air valve 302 and a pressure sensor 304 on the open air passage 17 between the canister 19 and the air filter 42. Further, the pressure sensor 25 is not disposed. The control unit 102 opens and closes the open air valve 302, by which the open air valve 302 is switched between a communicating state of being open and a non-communicating state of being closed. In the communicating state, the open air passage 17 is opened and the canister 19 communicates with the open air via the air filter 42. On the other hand, in the non-communicating state, the open air passage 17 is closed by the open air valve 302 and communication between the canister 19 and the open air is cut off.

The pressure sensor 304 detects a pressure in the open air passage 17 between the canister 19 and the open air valve 302.

Figure 6:
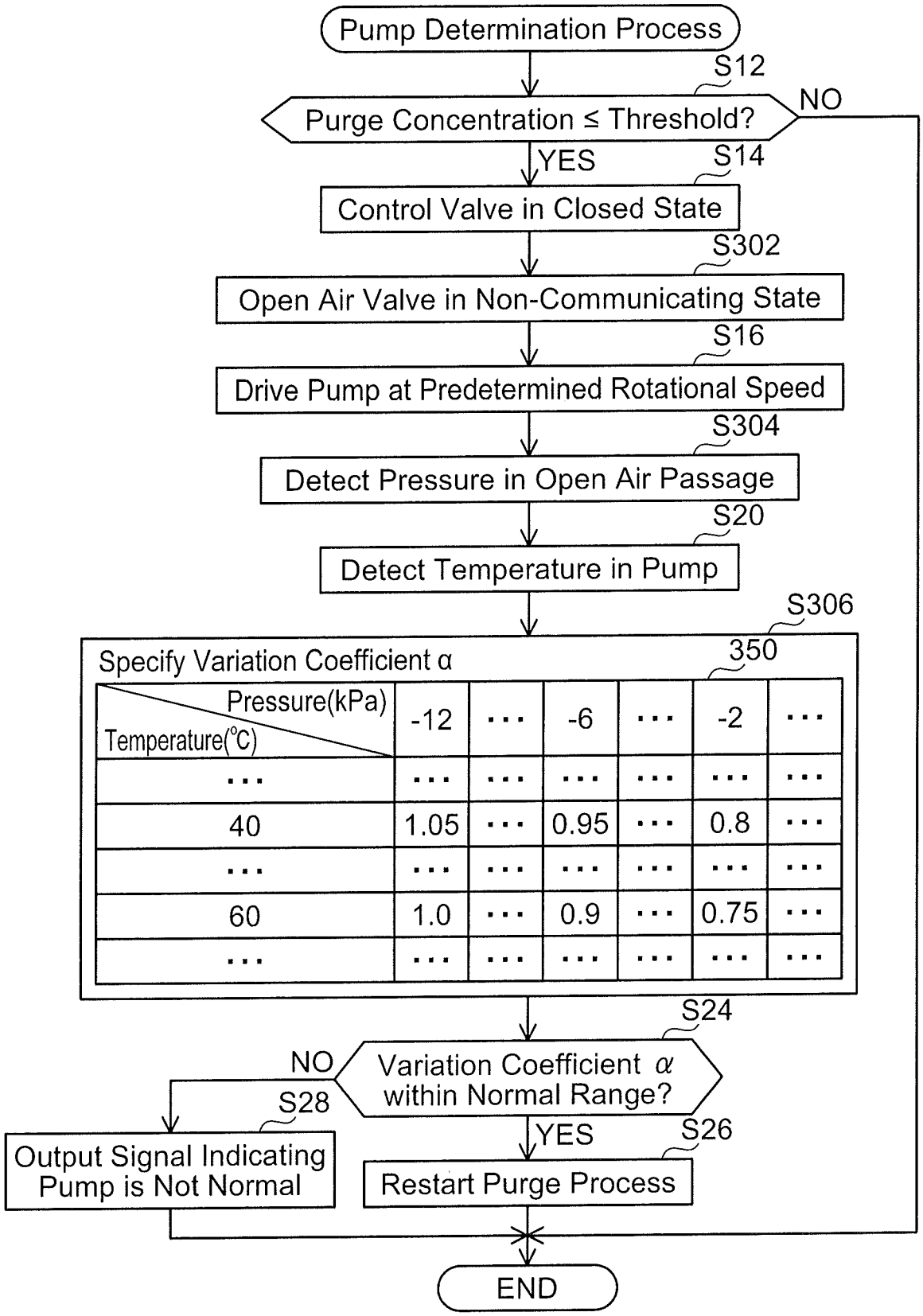
FIG. 6 shows a flowchart of a pump determination process according to the third embodiment.

Next, a pump determination process will be described. As shown in FIG. 6, in the pump determination process, after the processes of S12 and S14 are executed, the open air valve 302 is switched from open to closed in S302, by which it is switched from the communicating state to the non-communicating state. Then, the process of S16 is executed. Then, in S304, the control unit 102 detects a pressure in the open air passage 17 by using the pressure sensor 304. In S304, the pressure in the open air passage 17 is detected in a situation where the control valve 26 is in the closed state, the open air valve 302 is in the non-communicating state, and the pump 48 pressurizes the purge gas in the purge passage 24 on the control valve 26 side at the predetermined rotational speed (hereinbelow this pressure will be termed "non-communicating pressure value").

Next, the process of S20 is executed. Then, in S306, the control unit 102 specifies a variation coefficient α. Specifically, the control unit 102 stores a data map 350 indicating a correlation of pressure-temperature-variation coefficient.

The data map 350 is specified by experiments similar to those of the data map 150, and is stored in advance. In the experiments to specify the data map 350, non-communicating pressure values are specified, instead of the closed pressure values. The control unit 102 specifies a variation coefficient α corresponding to the non-communicating pressure value detected in S304 and the temperature in the pump 48 detected in S20 from the data map 350. Then, it executes the processes of S24 to S28 and terminates the pump determination process.

Further, the open air passage 17 can be brought to have a negative pressure by the open air valve 302 being switched to the non-communicating state while the pump 48 is driven. A magnitude of the negative pressure at this occasion is correlated with the individual difference of the pump. Due to this, the flow rate of the gas discharged from the pump 48 can be estimated by using the non-communicating pressure value. According to this embodiment as well, the flow rate of the purge gas discharged from the pump 48 can be estimated by using the characteristic of the pump 48 that is actually mounted in the evaporated fuel processing device 20, that is, by using the non-communicating pressure value and the temperature in the pump 48.

Fourth Embodiment

Figure 7:
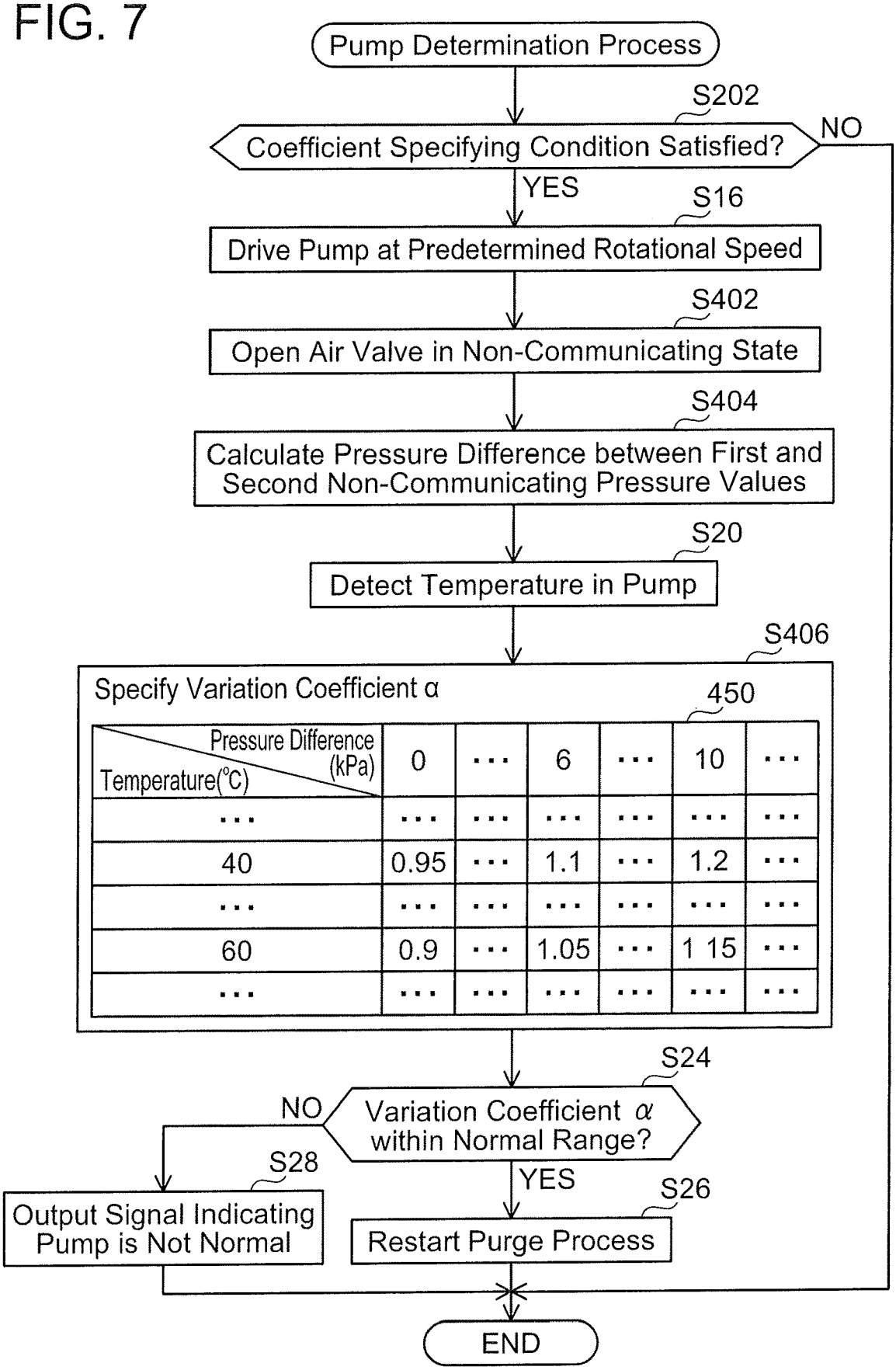
FIG. 7 shows a flowchart of a pump determination process according to a fourth embodiment.

Differences from the third embodiment will be described. In the present embodiment, a variation coefficient α is specified while the purge process is executed, similarly to the second embodiment. Specifically, a pump determination process shown in FIG. 7 is executed.

The pump determination process is started when the vehicle is started (for example, when the ignition switch is switched from off to on). Firstly, the processes of S202 and S16 are executed. Then, in S402, the control unit 102 switches the open air valve 302 from the communicating state to the non-communicating state. Then, in S404, the control unit 102 uses the pressure sensor 304 to detect a pressure value in the valve closed duration (that is, in the closed state that takes place while the control valve 26 is continuously switched between the closed state and the open state, and in which the open air valve 302 is in the non-communicating state and the pump 48 pressurizes the purge gas in the purge passage 24) (hereinbelow this pressure value will be termed "first non-communicating pressure value") and a pressure value in the valve open duration (that is, in the open state that takes place while the control valve 26 is continuously switched between the closed state and the open state, and in which the open air valve 302 is in the non-communicating state and the pump 48 discharges the purge gas to the purge passage 24) (hereinbelow this pressure value will be termed "second non-communicating pressure value") while the control valve 26 is controlled based on the duty cycle control, and calculates a pressure difference between the first non-communicating pressure value and the second non-communicating pressure value.

In S404, similarly to S204, the first non-communicating pressure value and the second non-communicating pressure value are detected after the switch of the control valve 26 from the open state to the closed state has been executed the preset number of times (such as three times). Further, the control unit 102 may detect a pressure difference plural times, and may calculate an average thereof as the pressure difference, or may calculate a difference between an average of the closed pressure values and an average of the open pressure values as the pressure difference.

Next, the process of S20 is executed. Then, in S406, the control unit 102 specifies a variation coefficient α. Specifically, the control unit 102 stores a data map 450 indicating a correlation of pressure difference-temperature-variation coefficient.

The data map 450 is specified by experiments and is stored in advance, similarly to the data map 150. In the experiments, first non-communicating pressure values and second non-communicating pressure values are detected at various temperatures in a plurality of pumps, instead of the closed pressure values in the case with the experiments for the data map 150. Then, the data map 450 is specified by calculating a discrepancy from the standard flow rate indicated by the data 110 of the measured flow rate in the situation where the control valve 26 is in the fully open state and the pump is driven at the predetermined rotational speed X1, that is, by calculating measured flow rate/standard flow rate=variation coefficient α, for each of the plurality of pumps.

The control unit 102 specifies a variation coefficient α corresponding to the pressure difference detected in S404 and the temperature in the pump 48 detected in S20 from the data map 450. Then, it executes the processes of S24 to S28 and terminates the pump determination process.

According to this embodiment as well, the flow rate of the purge gas discharged from the pump 48 can be estimated by using the characteristic of the pump 48 that is actually mounted in the evaporated fuel processing device 20, that is, by using the first non-communicating pressure value, the second non-communicating pressure value, and the temperature in the pump 48.

Fifth Embodiment

Differences from the first embodiment will be described. In the first embodiment, the closed pressure value and the temperature in the pump 48 are used to specify the variation coefficient α. In the present embodiment, a variation coefficient α is specified by using a voltage value applied to the pump 48 and a current value that flows in the pump 48, instead of the closed pressure value. As shown by the broken lines in FIG. 1, the pump 48 is provided with the voltage sensor 48*a* configured to detect a voltage applied to the pump 48 and the current sensor 48*b* configured to detect a current that flows in the pump 48.

Figure 8:
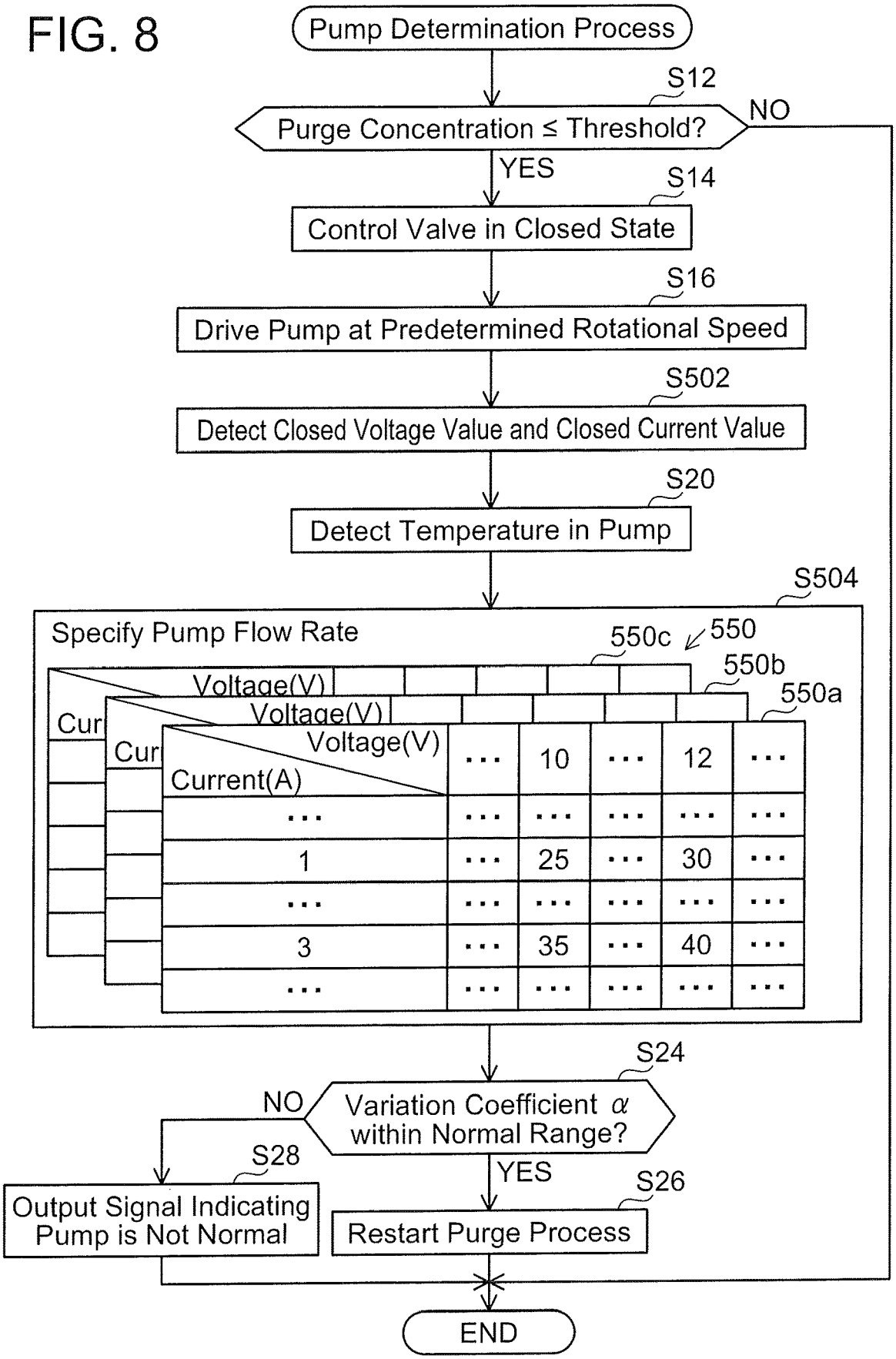
FIG. 8 shows a flowchart of a pump determination process according to a fifth embodiment.

Specifically, as shown in FIG. 8, in a pump determination process, after the processes of S12 to S16 are executed, a voltage applied to the pump 48 and a current that flows in the pump 48 are detected in the situation where the control valve 26 is in the closed state and the pump 48 pressurizes the purge gas in the purge passage 24 on the control valve 26 side at the predetermined rotational speed, by using the voltage sensor and the current sensor in S502 (hereinbelow the voltage and current will be termed "closed voltage value" and "closed current value", respectively).

Next, the process of S20 is executed. Then, in S504, the control unit 102 calculates variation coefficients α. Specifically, the control unit 102 stores a data map 550 indicating a correlation of voltage-current-flow rate for each of a plurality of temperatures in the pump 48. The data map 550 includes a plurality of data maps 550*a*, 550*b*, 550*c* respectively corresponding to the plurality of temperatures.

The data map 550 is specified by experiments similarly to those of the data map 150, and is stored in advance. In the experiments to specify the data map 550, closed voltage values and closed current values are specified, instead of the closed pressure values. Further, measured flow rates are recorded, instead of the variation coefficients α. The control unit 102 specifies a flow rate corresponding to the closed voltage value and the closed current value detected in S502 and the temperature in the pump 48 detected in S20 from the data map 550. Then, a variation coefficient α is calculated by dividing the specified flow rate by the flow rate Z corresponding to the pressure in the intake manifold IM. After this, the control unit 102 executes the processes of S24 to S28 and terminates the pump determination process.

According to this embodiment as well, the flow rate of the purge gas discharged from the pump 48 can be estimated by using the characteristic of the pump 48 that is actually mounted in the evaporated fuel processing device 20, that is, by using the closed current value, the closed voltage value, and the temperature in the pump 48.

Sixth Embodiment

Figure 9:
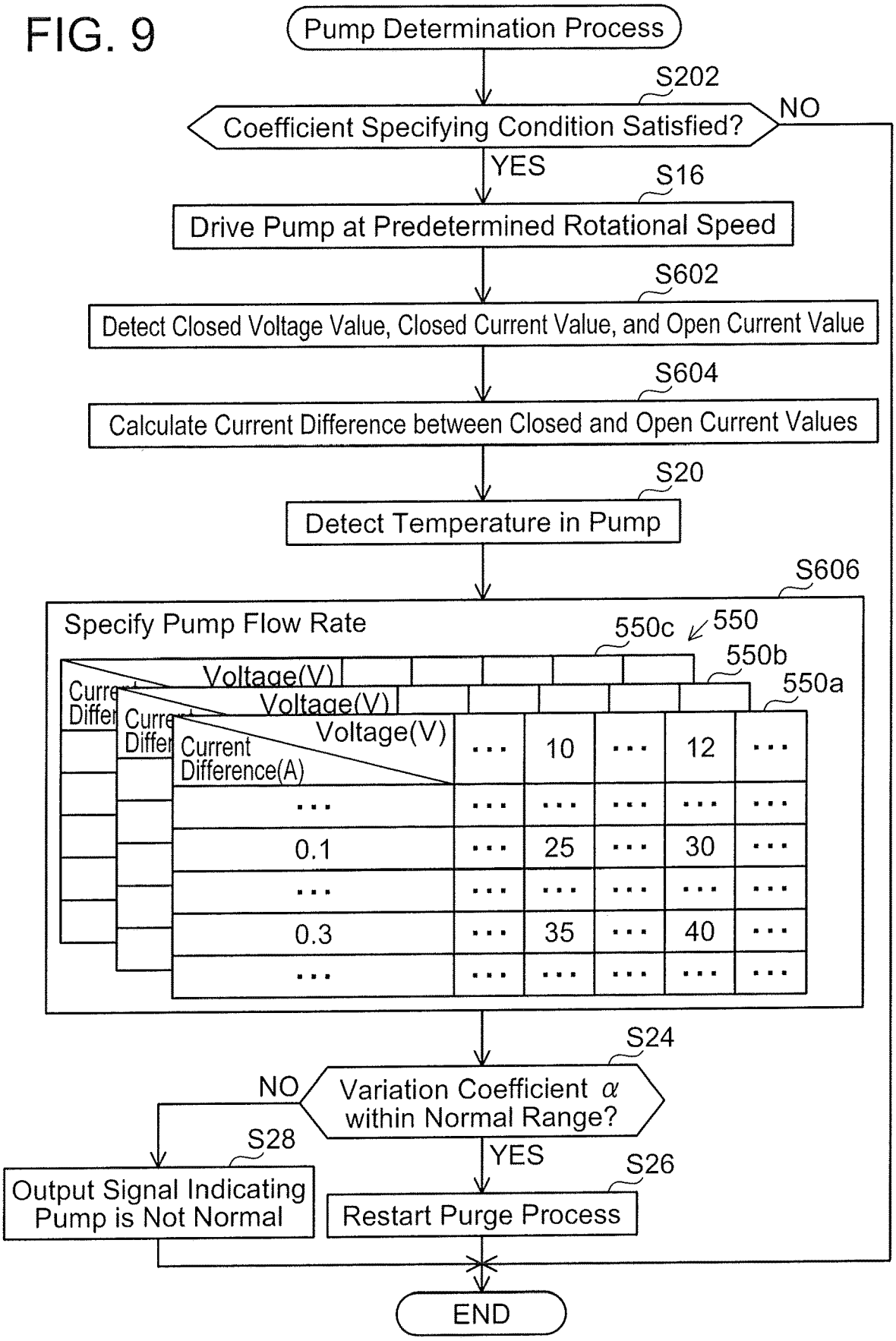
FIG. 9 shows a flowchart of a pump determination process according to a sixth embodiment.

Differences from the fifth embodiment will be described. In the present embodiment, a variation coefficient α is specified while the purge process is executed, similarly to the second and fourth embodiments. Specifically, a pump determination process shown in FIG. 9 is executed.

The pump determination process is started when the vehicle is started (for example, when the ignition switch is switched from off to on). Firstly, the processes of S202 and S16 are executed. Then, in S602, the control unit 102 uses the pressure sensor 25 to detect a closed voltage value and a closed current value during the valve closed duration (that is, in the situation where the control valve 26 is in the closed state and the pump 48 pressurizes the purge gas in the purge passage 24) and a current value during the valve open duration (that is, in the situation where the control valve 26 is in the open state and the pump 48 discharges the purge gas to the purge passage 24) (hereinbelow this current value will be termed "open current value") while the control valve 26 is controlled based on the duty cycle control. Then, in S604, the control unit 102 calculates a current change between the closed current value and the open current value.

In S602, similarly to S36, the closed voltage value, the closed current value, and the open current value are detected after the switch of the control valve 26 from the open state to the closed state has been executed the preset number of times (such as three times). Further, the control unit 102 may detect the closed voltage value, the closed current value, and the open current value plural times, and may calculate an average thereof as the current difference, or may calculate a difference between an average of the closed current values and an average of the open current values as the current difference.

Figure 10:
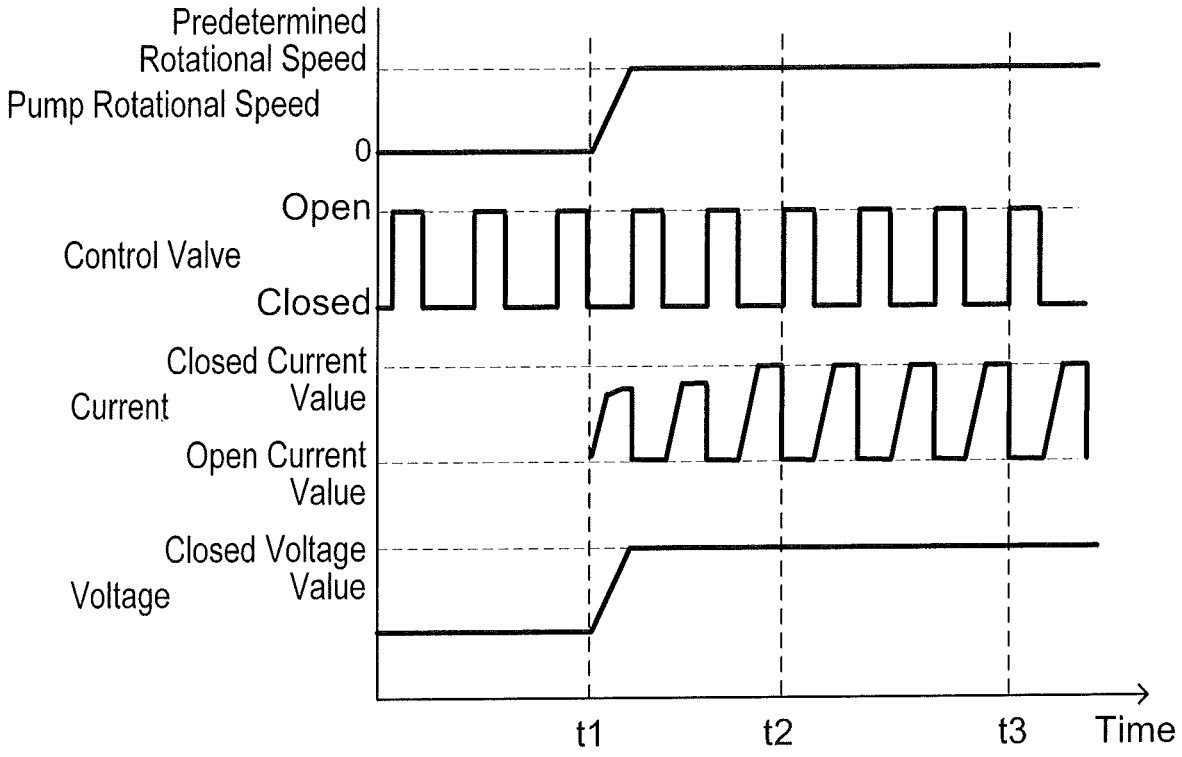
FIG. 10 shows a time chart indicating operation of a control valve and current and voltage values of a pump according to the sixth embodiment.

FIG. 10 shows the rotational speed of the pump 48, the opening and closing timings of the control valve 26, the voltage value, and changes in the current when the pump 48 is driven in S16. Immediately after the pump 48 starts to be driven (that is, time t1 to time t2), the closed current value changes each time the control valve 26 is switched from the open state to the closed state. In S602, the control unit 102 causes the closed current value and the open current value to be detected after the switch of the control valve 26 from the open state to the closed state has been executed the preset number of times (such as three times) (that is, at time t2) after S34 (that is, time t1). Similarly, the control unit 102 causes the closed voltage value to be detected after the switch of the control valve 26 from the open state to the closed state has been executed the preset number of times (such as three times) (that is, at time t2) after S34. The voltage value of the pump 48 hardly changes between when the control valve 26 is in the open state and when it is in the closed state. As such, the closed voltage value may be a voltage value that is detected when the control valve 26 is in the open state.

Further, during when the control valve 26 is controlled based on the duty cycle control, the closed current value and the closed voltage value change slightly even after the switch has been executed the preset number of times (such as three times). Due to this, the control unit 102 may detect a current difference between the closed current value and the open current value plural times (time t2 to time t3), and may calculate an average thereof as the current difference, or may calculate a difference between an average of the closed current values and an average of the open current values as the current difference.

Next, the control unit 102 executes the process of S20. Then, in S606, the control unit 102 specifies a variation coefficient α. Specifically, the control unit 102 stores a data map 650 indicating a correlation of current-voltage-flow rate for each of a plurality of temperatures in the pump 48. The data map 650 includes a plurality of data maps 650*a* to 650*c* respectively corresponding to the plurality of temperatures.

The data map 650 is specified by experiments similar to those of the data map 550, and is stored in advance. Similarly to S504, the control unit 102 calculates a variation coefficient α by dividing the flow rate specified from the data map 650 by the purge gas flow rate calculated by using the pressure in the intake manifold IM, the rotational speed X2 of the pump 48, and the duty cycle Y. After this, the control unit 102 executes the processes of S24 to S28 and terminates the pump determination process.

According to this embodiment as well, the flow rate of the purge gas discharged from the pump 48 can be estimated by using the characteristic of the pump 48 that is actually mounted in the evaporated fuel processing device 20, that is, by using the closed current value, the open current value, the closed voltage value, and the temperature in the pump 48.

In the fifth and sixth embodiments, as variants thereof, the data maps 550, 650 may record variation coefficients α instead of the flow rates, similarly to the first to fourth embodiments. In these cases, the control unit 102 may estimate the flow rate of the purge gas from the pump 48 by multiplying the purge gas flow rate calculated by using the rotational speed X2 of the pump 48 and the duty cycle Y by the variation coefficient α.

Seventh Embodiment

Differences from the first embodiment will be described. In the present embodiment, the control unit 102 executes a flow rate adjusting process, instead of the pump determination process. In the flow rate adjusting process, the rotational speed of the pump 48 is adjusted in accordance with a discrepancy in the flow rate of the pump 48.

Figure 11:
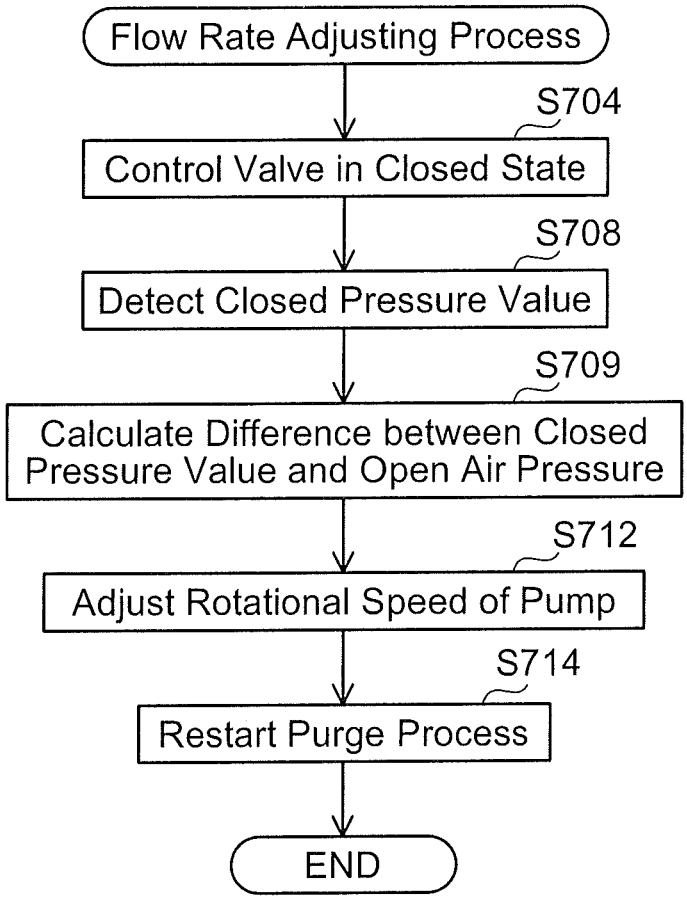
FIG. 11 shows a flowchart of a flow rate adjusting process according to a seventh embodiment.

The flow rate adjusting process is executed while the purge process is executed. In the purge process, the pump 48 is driven at a predetermined rotational speed. As shown in FIG. 11, in the flow rate adjusting process, the control unit 102 firstly in S704 stops the duty cycle control of the control valve 26 and maintains it in the closed state.

Next, in S708, the control unit 102 uses the pressure sensor 25 to detect a closed pressure value. Then, in S709, the control unit 102 calculates a pressure difference between the closed pressure value detected in S708 and an atmospheric pressure. The purge passage 23 on a canister 19 side relative to the control valve 26 is communicated with the open air via the canister 19. As a result, when the control valve 26 is in the closed state, the pressure in the purge passage 23 is maintained at the atmospheric pressure. Due to this, it can be said that the pressure difference calculated in S709 is a pressure difference between the pressure in the purge passage 24 on the control valve 26 side relative to the pump 48 and the pressure in the purge passage 23 on the canister 19 side relative to the pump 48 in the situation where the control valve 26 is in the closed state and the pump 48 pressurizes the gas in the purge passage 24 on the control valve 26 side. The atmospheric pressure may be detected by an atmospheric pressure sensor mounted in the vehicle, or may be stored in the control unit 102 in advance.

Figure 12:
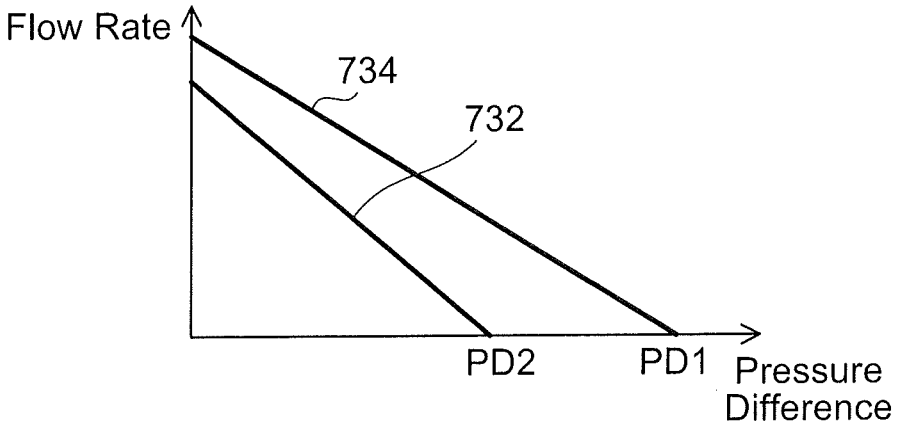
FIG. 12 shows a graph indicating a relationship between pressure difference and flow rate from a pump according to the seventh embodiment.

Next, in S712, the control unit 102 adjusts the rotational speed of the pump 48 so that the pressure difference between the closed pressure value and the atmospheric pressure becomes identical to a standard pressure difference. FIG. 12 shows a relationship between the flow rate of the purge gas from the pump 48 and the pressure difference between the closed pressure value and the atmospheric pressure during the purge process. A vertical axis indicates the flow rate of the purge gas and a horizontal axis indicates the pressure difference. The pressure difference is an average of pressure differences taken while the control valve 26 is controlled based on the duty cycle control. For example, the average of pressure differences can be calculated by computing $M\cdot(1-L)+N\cdot L$, where the pressure difference between the closed pressure value and the atmospheric pressure is M, the difference between the pressure in the purge passage 24 in the case where the control valve 26 is in the open state (that is, the open pressure value) and the atmospheric pressure is N, and the duty cycle (that is, the ratio of the valve open duration relative to a total duration of the valve open duration and the valve closed duration) is L. Since the open pressure value is almost equal to the atmospheric pressure, it can be said N=0. A lowest point on the vertical axis of FIG. 12 indicates flow rate=0 g/min, corresponding to the state in which the control valve 26 is in the closed state and the pump 48 pressurizes the purge gas in the purge passage 24.

For example, in a case where the purge concentration is relatively low, the flow rate of the purge gas from the pump 48 and the pressure difference exhibit a relationship of a line 732. As the purge concentration becomes higher, the purge gas density becomes higher. As a result, as shown by a line 734, the pressure difference becomes higher as compared to the case where the purge concentration is low, by which the flow rate from the pump 48 increases accordingly. In a case where a pressure difference PD1 is detected in S709, the control unit 102 adjusts the rotational speed of the pump 48 in S712 so that the pressure difference between the closed pressure value and the atmospheric pressure becomes identical to a standard pressure difference PD2.

Next, in S714, the control unit 102 restarts the purge process by restarting the duty cycle control of the control valve 26, and terminates the flow rate adjusting process.

In the flow rate adjusting process, the flow rate from the pump 48 is maintained at the standard flow rate by adjusting the rotational speed of the pump 48 while taking the variation in the flow rate from the pump 48 into account. Due to this, the variation in the flow rate from the pump 48 can be suppressed.

Eighth Embodiment

Figure 13:
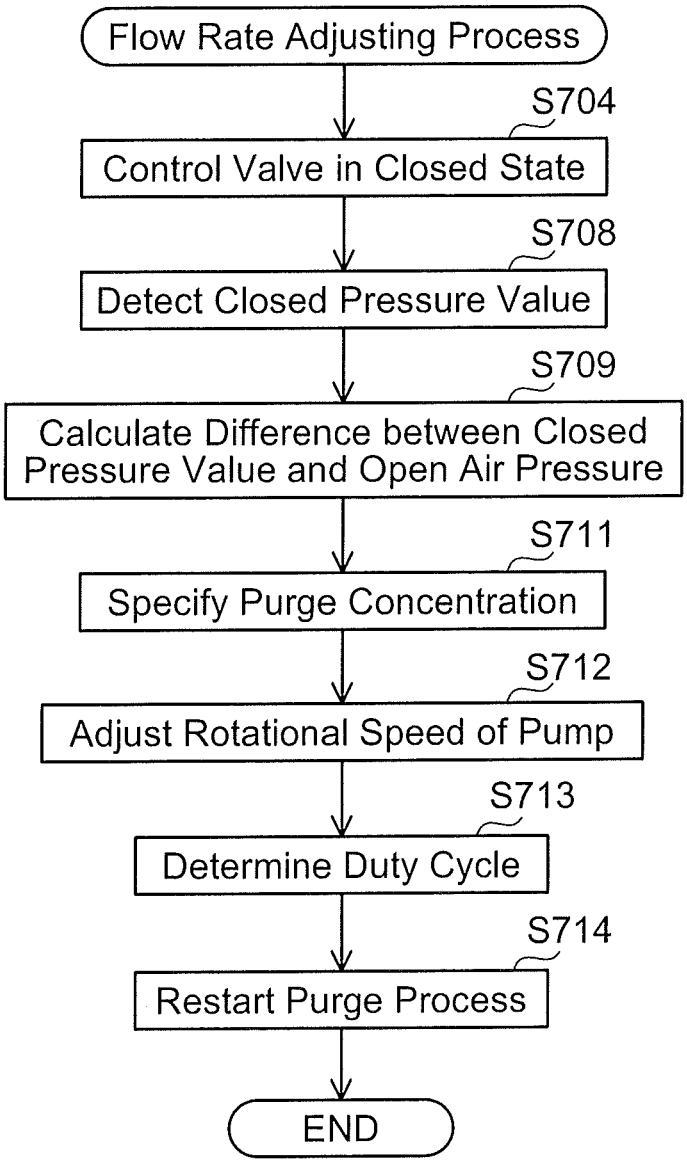
FIG. 13 shows a flowchart of a flow rate adjusting process according to an eighth embodiment.

Differences from the seventh embodiment will be described. This embodiment differs from the seventh embodiment regarding its flow rate adjusting process. As shown in FIG. 13, in the flow rate adjusting process, after the process of S709, the control unit 102 specifies a purge concentration in S711 by using the pressure difference calculated in S709. When the purge concentration changes, the purge gas density changes. When the purge gas density changes, the purge gas flow rate changes even if the pump 48 is driven at a constant rotational speed. Similarly, when the purge concentration changes, the closed pressure value changes in correlation to the purge concentration. The control unit 102 stores in advance a data map (not shown) that indicates a relationship between the pressure difference, that is, the value obtained by subtracting the atmospheric pressure from the closed pressure value, and the purge concentration. The data map that indicates the relationship between the pressure difference and the purge concentration is specified by experiments in advance, and is stored in the control unit 102.

In S711, the control unit 102 specifies a purge concentration related to the pressure difference calculated in S709, in the data map indicating the relationship between the pressure difference and the purge concentration. Then, it executes the process of S712. Then, in S713, the control unit 102 determines a duty cycle for the control valve 26 by using the purge concentration specified in S711. Specifically, the control unit 102 specifies the duty cycle by setting a smaller duty cycle for the control valve 26 (that is, a shorter valve open duration) for a higher purge concentration. Then, the control unit 102 executes the process of S714 and terminates the flow rate adjusting process. In S714, the control valve 26 is controlled based on the duty cycle control at the duty cycle determined in S713.

In the flow rate adjusting process, the flow rate from the pump 48 is maintained at the standard flow rate by adjusting the rotational speed of the pump 48 while taking the variation in the flow rate from the pump 48 into account. Due to this, the variation in the flow rate from the pump 48 can be suppressed. Further, the duty cycle is adjusted according to the purge concentration. Due to this, a quantity of the fuel supplied to the engine 2 by the purge process can be suppressed from becoming excessive.

Ninth Embodiment

Differences from the eighth embodiment will be described. In this embodiment, a purge concentration specified by using the air-fuel ratio is acquired in S711. Specifically, the control unit 102 executes a concentration estimating process shown in FIG. 14.

A timing to acquire the purge concentration may be any timing that is before S714 in the flow rate adjusting process. Further, the control unit 102 may execute the concentration estimating process during the flow rate adjusting process instead of S711.

According to this configuration as well, the effects similar to those of the eighth embodiment can be achieved.

Tenth Embodiment

Differences from the seventh embodiment will be described. In this embodiment, the control unit 102 stores a pump characteristic data set shown in FIG. 16. The pump characteristic data set includes a plurality of pump characteristic data corresponding to a plurality of purge concentrations. Each pump characteristic data indicates a relationship between the flow rate of the purge gas from the pump 48 and the pressure difference between the closed pressure value and the atmospheric pressure. A vertical axis indicates the flow rate of the purge gas and a horizontal axis indicates the pressure difference. The pressure difference is an average of pressure differences taken while the control valve 26 is controlled based on the duty cycle control, similarly to FIG. 12.

Figure 16:
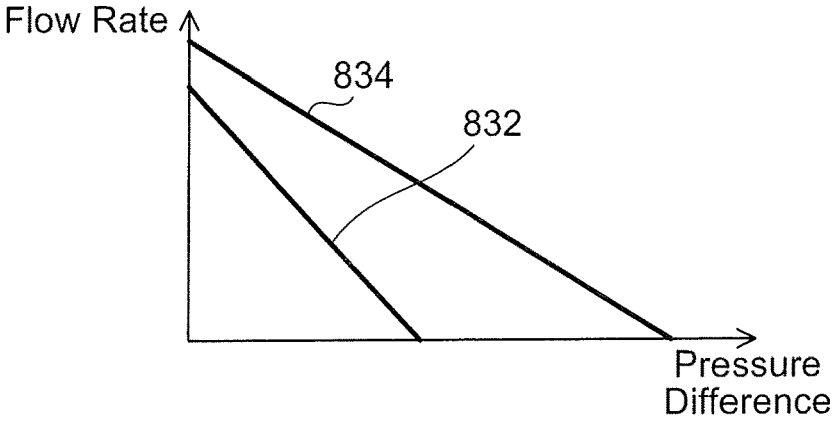
FIG. 16 shows a characteristic data map according to the tenth embodiment.

For example, in a case where the purge concentration is 0%, that is, the purge gas does not contain the evaporated fuel, the flow rate of the purge gas from the pump 48 and the pressure difference exhibits a relationship of a line 832. As the purge concentration becomes higher, the purge gas density becomes higher. As a result, as shown by a line 834, when the purge concentration becomes D % (such as D=10%), the pressure difference becomes higher and the flow rate from the pump 48 also increases. FIG. 16 shows the relationships of the flow rate of the purge gas from the pump 48 and the pressure difference between the closed pressure value and the atmospheric pressure only for two types of purge concentrations, however, in actuality, the pump characteristic data includes the relationships of the flow rate of the purge gas from the pump 48 and the pressure difference between the closed pressure value and the atmospheric pressure for a plurality of purge concentrations.

Figure 15:
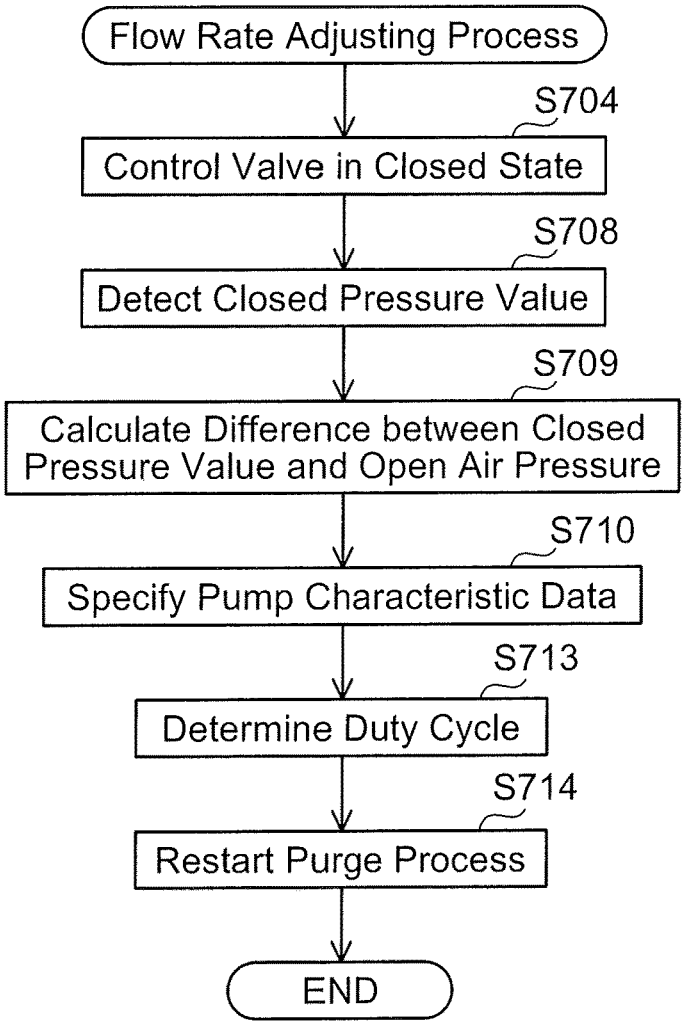
FIG. 15 shows a flowchart of a flow rate adjusting process according to a tenth embodiment.

As shown in FIG. 15, in a flow rate adjusting process of the present embodiment, the control unit 102 executes the processes of S704 to S709. Next, in S710, the control unit 102 specifies pump characteristic data by using the pressure difference calculated in S709. Specifically, the control unit 102 specifies pump characteristic data that includes the pressure difference of flow rate=0 g/min, which is closest to the pressure difference calculated in S709, from among the pump characteristic data set.

Next, in S713, the control unit 102 specifies a duty cycle of the control valve 26 by using the pump characteristic data specified in S710. The pressure difference in the pump characteristic data is determined based on the pressure difference between the closed pressure value and the atmospheric pressure and the duty cycle. For example, the pressure difference in the pump characteristic data is calculated by $M\cdot(1-L)$, where the pressure difference between the closed pressure value and the atmospheric pressure is M and the duty cycle is L. As such, the control unit 102 specifies the pressure difference corresponding to a predetermined flow rate from the pump characteristic data specified in S710. Then, the control unit 102 calculates the duty cycle L at which the pressure difference corresponding to the predetermined flow rate obtained from the pump characteristic data becomes identical to the pressure difference calculated in S709$\cdot(1-L)$.

Next, the control unit 102 executes S714 and terminates the flow rate adjusting process.

According to this configuration, the pump characteristic data of the pump 48 can be specified. As a result, the flow rate of the purge gas from the pump 48 can suitably be adjusted by adjusting the divergence of the control valve 26 by using the specified pump characteristic data.

Eleventh Embodiment

In this embodiment, the control unit 102 calculates the purge gas flow rate at a timing immediately after the purge process is started by the purge condition being satisfied. When the purge process is started, the pump 48 receives a signal for driving at a predetermined rotational speed (such as 30,000 rpm) from the control unit 102. However, in a predetermined duration immediately after the purge process started (such as for 5 seconds), the rotational speed of the pump 48 is not stable, by which the purge gas flow rate changes. In this embodiment, the control unit 102 calculates the purge gas flow rate that changes during the predetermined duration as above. The predetermined duration above is a duration from when the pump 48 is started until it stabilizes, and differs depending on a type of the pump 48. When the purge condition is satisfied, the control unit 102 determines a duty cycle of the control valve 26 by using the purge concentration and the air-fuel ratio. The control unit 102 determines the duty cycle not to allow it to exceed a first upper limit value (such as 90%, 100%). The first upper limit value is a preset value.

Figure 18:
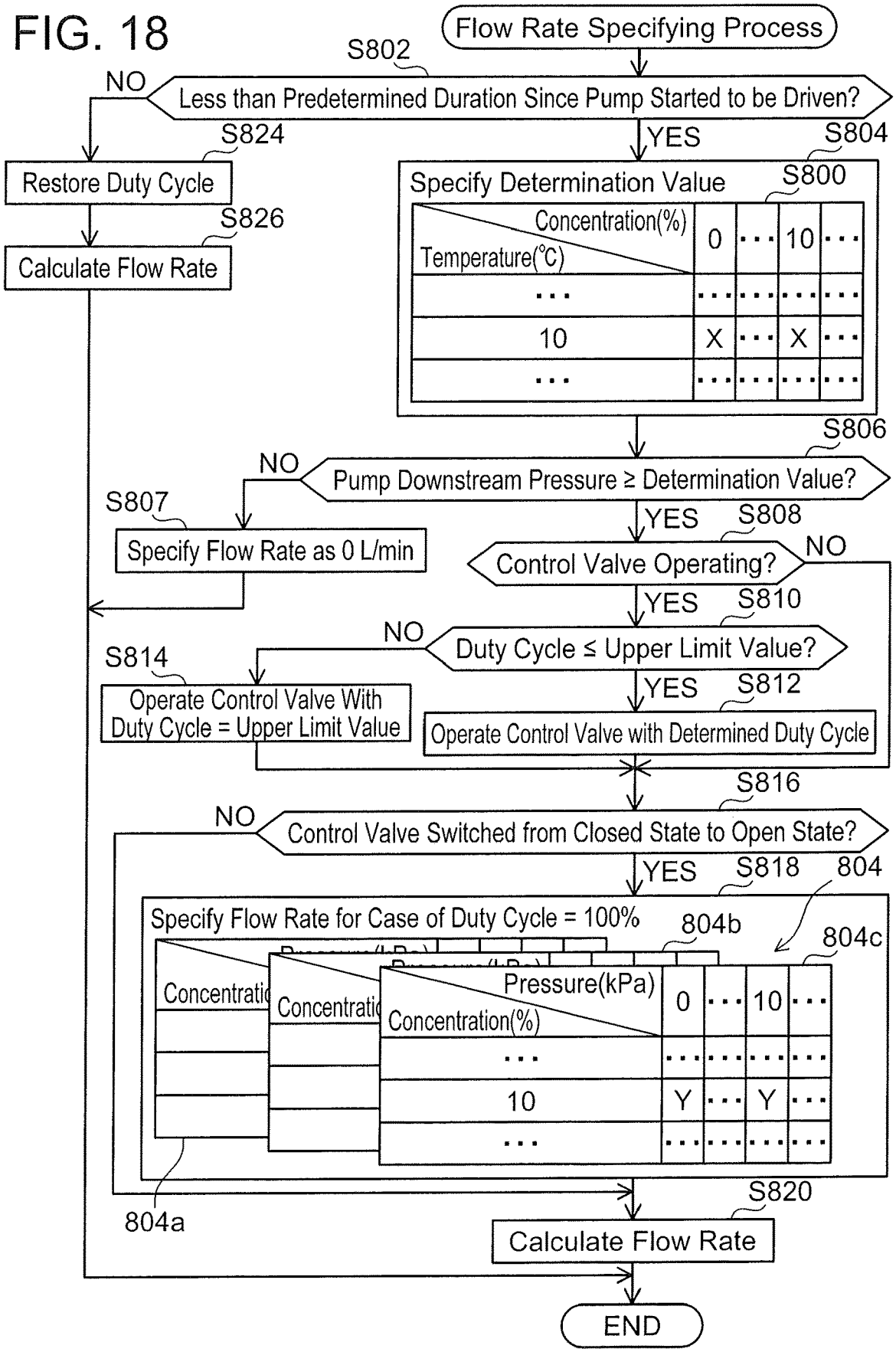
FIG. 18 shows a flowchart of a flow rate specifying process according to an eleventh embodiment.

A flow rate specifying process which the control unit 102 executes will be described with reference to FIG. 18. When the pump 48 is started in the purge process, the control unit 102 starts the flow rate specifying process. The pump 48 receives the signal for driving at the predetermined rotational speed (such as 30,000 rpm) from the control unit 102. The control unit 102 executes the flow rate specifying process repeatedly, for example, at 16 ms intervals while the purge process is executed. In the flow rate specifying process, firstly in S802, the control unit 102 determines whether or not a driving duration of the pump 48 since the pump 48 was started is less than a predetermined duration. In a case where the driving duration of the pump 48 is less than the predetermined duration (YES in S802), the control unit 102 specifies a determination value in S804 by using a data map 800. The data map 800 records temperatures in the pump 48, that is, temperatures detected by the temperature sensor 49, purge concentrations, that is, the purge concentrations specified in the concentration estimating process and stored in the ECU 100, and determination values (all of which are indicated as "X" in the data map 800) in association with each other. In the case where no purge concentration is stored in the ECU 100, the purge concentration is regarded as being 0%. In the data map 800, a determination value is larger with a higher concentration, and a determination value is larger with a lower temperature.

Next, in S806, the control unit 102 determines whether or not the pressure on the downstream side relative to the pump 48, that is, the pressure detected by the pressure sensor 25 is equal to or greater than the determination value. In a case where the pressure is less than the determination value (NO in S806), the control unit 102 specifies the purge gas flow rate as being 0 L/min in S807, and terminates the flow rate specifying process. Immediately after the start of the pump 48, the purge gas cannot sufficiently be discharged to the intake passage 34. Due to this, such a situation in which the purge gas cannot sufficiently be discharged to the intake passage 34 by the pump 48 is determined by using the pressure on the downstream side relative to the pump 48. In the case where the pressure on the downstream side relative to the pump 48 is less than the determination value, the control valve 26 is maintained in the closed state since the purge gas cannot sufficiently be discharged to the intake passage 34 by using the pump 48. Due to this, the purge gas is not supplied to the intake passage 34, and the purge gas flow rate thereby becomes 0 L/min. That is, the determination value is an upper limit value of the pressure on the downstream side relative to the pump 48 for determining that the purge gas cannot sufficiently be discharged to the intake passage 34 by using the pump 48.

The pressure on the downstream side relative to the pump 48 is higher with a higher purge gas density. The purge gas density is larger with a lower temperature of the pump 48, and is larger with a higher purge concentration. Due to this, the determination value is set to become larger with a lower temperature of the pump 48 and a higher purge concentration. Due to this, the situation in which the purge gas cannot sufficiently be discharged to the intake passage 34 by using the pump 48 can suitably be determined by using the pressure on the downstream side relative to the pump 48.

In a case where the pressure detected by the pressure sensor 25 is equal to or greater than the determination value (YES in S806), the control unit 102 determines in S808 whether or not the control valve 26 is operating under the duty cycle control. In a case where the control valve 26 is not operating (YES in S808), the control unit 102 determines in S810 whether or not the duty cycle of the control valve 26, which is determined by the air-fuel ratio and the like, is equal to or less than a second upper limit value (such as 30%). The second upper limit value is smaller than the first upper limit value. In a case where the determined duty cycle is equal to or less than the second upper limit value (YES in S810), the control unit 102 starts to operate the control valve 26 with the determined duty cycle and proceeds to S816. On the other hand, in a case where the required duty cycle is greater than the upper limit value (NO in S810), the control unit 102 starts to operate the control valve 26 with the duty cycle of the second upper limit value, and proceeds to S816. Due to this, the duration in which the control valve 26 is in the closed state can be elongated by decreasing the duty cycle in an event where the duty cycle is large.

On the other hand, in a case where the control valve 26 is already operating in S808 (NO in S808), the control unit 102 skips S810 to S814 and proceeds to S816. In S816, the control unit 102 determines whether or not the control valve 26 has just been switched from the closed state to the open state while being controlled based on the duty cycle control. Specifically, the control unit 102 checks in S816 whether the control valve 26 is in the open state or in the closed state and records a result thereof in the control unit 102. Then, in a case where the checked state of the control valve 26 is the open state and the state of the control valve 26, which was recorded in the control unit 102 in S816 of the flow rate specifying process that was executed immediately before the current flow rate specifying process, is the closed state, the control unit 102 determines that the control valve 26 has just been switched from the closed state (YES in S816). In a case of YES in S816, the control unit 102 specifies in S818 the purge gas flow rate for a situation in which the control valve 26 is being operated with the duty cycle of 100% by using the pressure detected by the pressure sensor 25, that is, the pressure on the downstream side relative to the pump 48, the purge concentration and the temperature detected by the temperature sensor 49, that is, the temperature of the pump 48. The control unit 102 specifies the purge gas flow rate by using a data map 804 that is specified in advance by experiments and stored in the control unit 102.

In the data map 804, data maps 804*a*, 804*b*, 804*c* and so forth indicating relationships between the purge concentrations, the pressures on the downstream side relative to the pump 48, and the purge gas flow rates (which are indicated as "Y" in the data map 804) are prepared respectively for a plurality of temperatures of the pump 48. In this embodiment, the rotational speed required for the pump 48 during the purge process is constant. However, in a variant, the rotational speed required for the pump 48 during the purge process may change. In this case, the data map 804 may be stored in the control unit 102 in advance for each rotational speed of the pump 48.

Next, in S820, the control unit 102 calculates a purge gas flow rate and terminates the flow rate specifying process. Specifically, the control unit 102 calculates the purge gas flow rate by multiplying the purge gas flow rate specified in S818 by the required duty cycle.

On the other hand, in a case where the control unit 102 determines that the control valve 26 has not just been switched from the closed state to the open state in S816 (NO in S816), that is, in a case where the checked state of the control valve 26 is the open state and the state of the control valve 26, which was recorded in the control unit 102 in S816 of the flow rate specifying process that took was executed immediately before the current flow rate specifying process, is the open state, or in a case where the checked state of the control valve 26 is the closed state, the control unit 102 skips S818 and proceeds to S820. In S820 in a case where S818 was skipped, the purge gas flow rate is calculated by using the flow rate that was specified in S818 most recently in the flow rate specifying process that was executed immediately before the current flow rate specifying process or at an earlier timing.

In a case where the predetermined duration has elapsed since the pump 48 started to be driven in S802 (NO in S802), the control unit 102 causes the control valve 26 to operate with the determined duty cycle in S824. Due to this, in the case where the duty cycle had been changed to the second upper limit value in S814, the duty cycle can be restored to the duty cycle which is larger than the determined duty cycle, that is, the second upper limit value. Next, in S826, the control unit 102 calculates a purge gas flow rate and terminates the flow rate specifying process. Specifically, the purge gas flow rate for the case where the duty cycle relative to the rotational speed of the pump 48 is 100% is specified in advance by experiments, and is stored in the control unit 102. Due to this, the control unit 102 calculates the purge gas flow rate by multiplying the pre-stored purge gas flow rate by the required duty cycle and terminates the flow rate specifying process.

Figure 19:
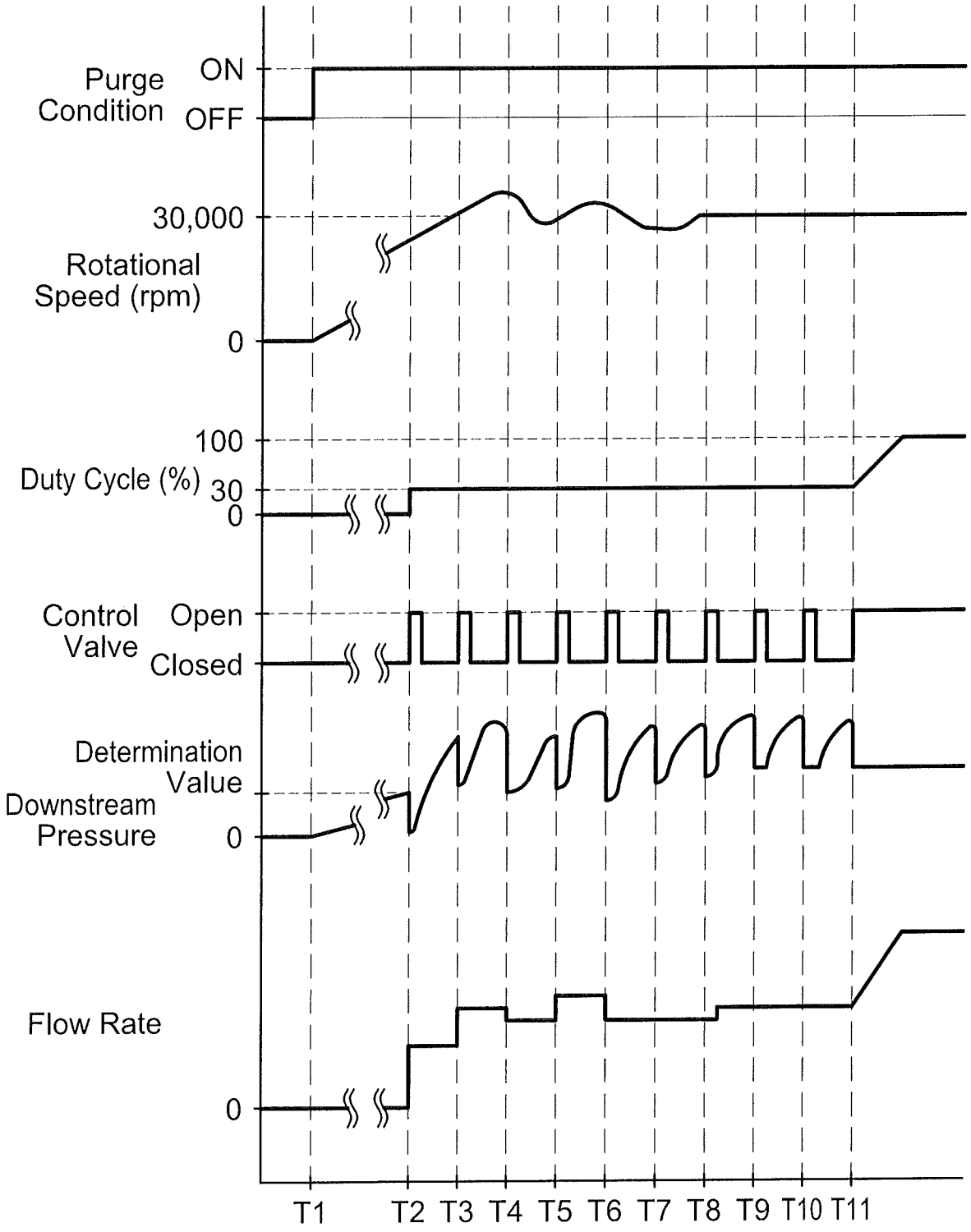
FIG. 19 shows a time chart indicating chronological changes in a purge condition, a rotational speed of a pump, a duty cycle of a control valve, a downstream pressure, and a flow rate of purge gas while the flow rate specifying process according to the eleventh embodiment is executed.

FIG. 19 shows a time chart indicating chronological changes in the purge condition, the rotational speed of the pump 48, the duty cycle of the control valve 26, the pressure on the downstream side relative to the pump 48 (hereinbelow termed "downstream pressure"), and the purge gas flow rate while the flow rate specifying process is executed after the purge process has been started.

At time T1, the pump 48 is started when the purge condition is satisfied (when the purge condition is switched from OFF to ON). After the purge condition has been satisfied, the signal for driving the pump 48 is supplied to the pump 48, by which the pump 48 is started. Due to this, a timing when the pump 48 is actually started is later than time T1 at which the purge condition is satisfied, however, in FIG. 19, the pump 48 is indicated as being started at time T1. The rotational speed of the pump 48 gradually rises. In a time period between time T1 and time T2, the downstream pressure is less than the determination value (NO in S806), thus the control valve 26 is maintained in the closed state and the purge gas is not supplied. When the downstream pressure becomes equal to or greater than the determination value (YES in S806) at time T2, the control valve 26 is started (S812 or S814).

Once the control valve 26 is started, the purge gas flow rate is calculated (S820) each time the control valve 26 switches from the closed state to the open state (time T3 to time T11) (YES in S816). A timing when the control valve 26 switches from the closed state to the open state may slightly differ from a timing when the process of S816 is executed.

While the rotational speed of the pump 48 is not stabilized, that is, in a time period between time T2 and time T8, the purge gas flow rate calculated in S820 varies. In the flow rate specifying process, the purge gas flow rate while the rotational speed of the pump 48 is not stabilized can suitably be specified.

After the rotational speed of the pump 48 has been stabilized, that is, after T9, the purge gas flow rate stabilizes. At time T11 when the predetermined duration has elapsed since the pump 48 started to be driven (NO in S802), the control unit 102 drives the control valve 26 with the determined duty cycle (which is 100% in FIG. 19), and calculates the purge gas flow rate (S826).

In FIG. 19, the rotational speed of the pump 48 before time T1 is 0 rpm, however, at a timing when the purge process is started again after the purge process has been terminated, the rotational speed of the pump 48 may be greater than 0 rpm.

Corresponding Relationship

In the present embodiment, the pressure on the downstream side relative to the pump 48 acquired in S806 is an example of "characteristic value".

In a variant, a supercharger may be disposed on the intake passage 34. In this case, the communication passage 28 may be disposed on an upstream side relative to the supercharger. Further, in a variant, an intake throttle valve may be disposed on the intake passage 34 on the upstream side relative to the supercharger. The intake throttle valve may have a same configuration as the throttle valve. The intake throttle valve may narrow the intake passage 34 on the upstream side relative to the supercharger to generate a negative pressure in the intake passage 34 on the upstream side relative to the supercharger. In this case, the communication passage 28 may be disposed on the intake passage 34 on the upstream side relative to the supercharger and may be disposed on whichever of upstream and downstream sides relative to the intake throttle valve.

While specific examples of the present disclosure have been described above in detail, these examples are merely illustrative and place no limitation on the scope of the patent claims. The technology described in the patent claims also encompasses various changes and modifications to the specific examples described above.

(1) In the first to fourth embodiments above, the data maps 150, 250, 350, 450 record the variation coefficients α. However, the data maps 150, 250, 350, 450 may record the flow rates of the purge gas from the pump 48 instead of the variation coefficients α, similarly to the data maps 550, 650. In this case, the control unit 102 may calculate a value that is obtained by dividing the purge gas flow rate specified from the data maps 150, 250, 350, 450 by the flow rate Z corresponding to the pressure in the intake manifold IM as the variation coefficient α.

(2) In the second, fourth, and sixth embodiments above, the determination is made on whether or not the coefficient specifying condition is satisfied in the process of S202 in the pump determination process. In doing so, the coefficient specifying condition may not include the condition (II). In this case, the duty cycle may be changed to a predetermined duty cycle (such as 40%) during the pump determination process.

(3) In the first to sixth embodiments above, the temperature in the pump 48 is detected. However, the temperature in the pump 48 may not be detected. In this variant, for example, the data map 150 of the first embodiment may be a data map that indicates a correlation between the closed pressure value and the variation coefficient. The same applies to the second to sixth embodiments.

(4) In the first to sixth embodiments above, the determination on whether or not the pump 48 is driving normally is made by using the variation coefficient α. However, the determination on whether or not the pump 48 is driving normally may not be made. That is, in the pump determination process, the processes of S24 and S28 may not be executed.

(5) In the first to sixth embodiments above, the determination on whether or not the pump 48 is driving normally is made by using the variation coefficient α. However, the determination on whether or not the pump 48 is driving normally may be made by using the flow rate of the purge gas from the pump 48.

(6) In the pump determination process of the above embodiments, the coefficient specifying condition is satisfied when all of the three conditions (I) to (III) are satisfied. However, the coefficient specifying condition may be determined as being satisfied even when at least one of the conditions (I) to (III) is not satisfied.

(7) The purge concentration may be detected by a purge concentration detecter disposed on the purge passage 24, for example.

(8) The control unit 102 may be provided separately from the ECU 100.

(9) In the seventh to tenth embodiments above, the pressure difference between upstream and downstream sides relative to the pump 48 is calculated by using the pressure sensor 25. However, the pressure difference between upstream and downstream sides relative to the pump 48 may be acquired by means other than the pressure sensor 25. For example, the pressure difference may be detected by using a pressure difference sensor to which the purge passages 23, 24 located upstream and downstream sides relative to the pump 48 are connected. Alternatively, the pressure difference may be detected by using a bypass passage that is connected to the purge passages 23, 24 located upstream and downstream sides relative to the pump 48 and disposed parallel to the pump 48, an orifice disposed on the bypass passage, and a pressure difference sensor configured to detect a pressure difference between upstream and downstream sides relative to the orifice.

(10) In the first to sixth embodiments above, the experiments are conducted by using the purge gas with the relatively low purge concentration for specifying the data maps 150, 250, 350, 450, 550, 650. However, in specifying the data maps 150, 250, 350, 450, 550, 650, the experiments may be conducted by using plural purge gases having different purge concentrations, and the data maps may be specified for each of the purge concentrations. In this case, the determination on whether or not the purge concentration is equal to or less than the threshold (such as S12 of FIG. 2) may not be executed in the pump determination process. Further, in specifying the variation coefficient $\alpha$, a data map corresponding to the actual purge concentration may be selected.

The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. An evaporated fuel processing device comprising:

a canister configured to store evaporated fuel;

a control valve disposed on a purge passage communicating the canister and an intake passage of an engine and configured to switch between a closed state and an open state, the closed state being a state of closing the purge passage, and the open state being a state of opening the purge passage;

a pump disposed on the purge passage between the canister and the control valve;

an acquiring unit configured to acquire a characteristic value related to a characteristic of the pump in a situation where the control valve is in the closed state and the pump pressurizes gas in the purge passage on a control valve side relative to the pump; and an estimating unit configured to estimate a flow rate of the gas that the pump discharges to the purge passage on the control valve side when the control valve is in the open state, by using the acquired characteristic value.

2. The evaporated fuel processing device as in claim 1, wherein the acquiring unit comprises a first pressure detecting unit configured to detect a pressure in the purge passage on the control valve side, and the characteristic value includes a closed pressure value detected by the first pressure detecting unit.

3. The evaporated fuel processing device as in claim 2, wherein the characteristic value includes the closed pressure value in a situation where the control valve is in the closed state while the control valve continuously switches between the closed state and the open state, the acquiring unit is further configured to acquire an open pressure value detected by the first pressure detecting unit in a situation where the pump discharges the gas to the purge passage on the control valve side and the control valve is in the open state while the control valve continuously switches between the closed state and the open state, the characteristic value further includes the open pressure value, and the estimating unit is configured to estimate the flow rate of the gas by using a difference between the closed pressure value and the open pressure value.

4. The evaporated fuel processing device as in claim 1, wherein the acquiring unit comprises:

a voltage detecting unit configured to detect a voltage of the pump; and a current detecting unit configured to detect a current of the pump, and the characteristic value includes a closed voltage value detected by the voltage detecting unit and a closed current value detected by the current detecting unit, the closed voltage value and the closed current value being detected when the pump is driven at a predetermined rotational speed.

5. The evaporated fuel processing device as in claim 4, wherein the characteristic value includes the closed voltage value and the closed current value in a situation where the control valve is in the closed state while the control valve continuously switches between the closed state and the open state, the acquiring unit is further configured to acquire an open current value detected by the current detecting unit in a situation where the pump discharges the gas to the purge passage on the control valve side and the control valve is in the open state while the control valve continuously switches between the closed state and the open state, the characteristic value further includes the open current value, and the estimating unit is configured to estimate the flow rate of the gas by using the closed voltage value and a difference between the closed current value and the open current value.

6. The evaporated fuel processing device as in claim 1, wherein the canister is configured to communicate with open air via an open air passage, the evaporated fuel processing device further comprises an open air valve configured to switch between a communicating state and a non-communicating state, the communicating state being a state where the canister communicates with the open air via the open air passage and the non-communicating state being a state where the canister does not communicate with the open air via the open air passage, the acquiring unit comprises a second pressure detecting unit configured to detect a pressure in the open air passage on a canister side relative to the open air valve, and the characteristic value includes a non-communicating pressure value detected by the second pressure detecting unit in a situation where the open air valve is in the non-communicating state.

7. The evaporated fuel processing device as in claim 6, wherein the characteristic value includes the non-communicating pressure value in a situation where the control valve is in the closed state while the control valve continuously switches between the close state and the open state, the acquiring unit is further configured to acquire a second non-communicating pressure value detected by the second pressure detecting unit in a situation where the pump discharges the gas to the purge passage on the control valve side, the control valve is in the open state while the control valve continuously switches between the closed state and the open state, and the open air valve is in the non-communicating state, the characteristic value further includes the second non-communicating pressure value, and the estimating unit is configured to estimate the flow rate of the gas by using a difference between the non-communicating pressure value and the second non-communicating pressure value.

8. The evaporated fuel processing device as in claim 2, wherein the acquiring unit further comprises a temperature detecting unit configured to detect a temperature in the pump, and the characteristic value further includes a temperature detected by the temperature detecting unit while the pump is driven.

9. The evaporated fuel processing device as in claim 1, wherein the estimating unit stores a standard flow rate of the gas discharged from the pump to the purge passage on the control valve side in a situation where the control valve is in the open state, and the estimating unit is configured to estimate the flow rate of the gas by using the characteristic value to specify a coefficient indicating a discrepancy from the standard flow rate and using the specified coefficient to modify the standard flow rate.

10. The evaporated fuel processing device as in claim 1, further comprising:

a control unit configured to continuously switch the control valve between the open state and the closed state, wherein the control unit is configured to switch the control valve according to a duty cycle, the duty cycle indicating a ratio of duration of the open state to duration of one set of the open state and the closed state that continuously take place while the control valve continuously switches between the closed state and the open state, the gas, which is discharged from the pump to the purge passage on the control valve side in a situation where the control valve is in the open state while the control valve continuously switches between the closed state and the open state according to the duty cycle, is supplied to the intake passage, and in a case where a driving duration of the pump since the pump started being driven is less than a predetermined duration:

the control unit switches the control valve according to a second upper limit value of the duty cycle or less, the second upper limit value being less than a first upper limit value of the duty cycle that is used when the driving duration of the pump since the pump started being driven is equal to or more than the predetermined duration;

the acquiring unit acquires the characteristic value in a situation where the control valve is in the closed state while the control valve continuously switches according to the duty cycle; and the estimating unit estimates the flow rate of the gas discharged from the pump to the purge passage on the control valve side by using the acquired characteristic value.

11. An evaporated fuel processing device comprising:

a canister configured to store evaporated fuel;

a control valve disposed on a purge passage communicating the canister and an intake passage of an engine and configured to switch between a closed state and an open state, the closed state being a state of closing the purge passage and the open state being a state of opening the purge passage;

a pump disposed on the purge passage between the canister and the control valve;

an acquiring unit configured to acquire a pressure difference between a pressure in the purge passage on a control valve side of the pump and a pressure in the purge passage on a canister side of the pump in a situation where the control valve is in the closed state and the pump pressurizes gas in the purge passage on the control valve side; and an adjusting unit configured to adjust a flow rate of the gas that the pump discharges to the purge passage on the control valve side in a situation where the control valve is in the open state, by using the acquired pressure difference.

12. The evaporated fuel processing device as in claim 11, wherein the adjusting unit stores in advance a standard pressure difference for the pressure difference between the pressure in the purge passage on the control valve side and the pressure in the purge passage on the canister side in the situation where the control valve is in the closed state and the pump pressurizes gas in the purge passage on the control valve side, and the adjusting unit is configured to adjust the flow rate of the gas that the pump discharges to the purge passage on the control valve side in a situation where the control valve is in the open state, by adjusting a rotational speed of the pump such that the acquired pressure difference becomes identical to the standard pressure difference.

13. The evaporated fuel processing device as in claim 11, wherein the adjusting unit stores in advance pump characteristic data for each of plural evaporated fuel concentrations of the gas, each of the pump characteristic data indicating a relationship between the flow rate of the gas from the pump and the pressure difference that varies according to a divergence of the control valve, each of the pump characteristic data includes the pressure difference in the situation where the control valve is in the closed state and the pump pressurizes the gas in the purge passage on the control valve side, the gas does not flow out from the pump in the situation where the control valve is in the closed state and the pump pressurizes the gas in the purge passage on the control valve side, and the adjusting unit is configured to:

specify one pump characteristic data from the plurality of pump characteristic data by using the pressure difference in the situation where the control valve is in the closed state and the pump pressurizes the gas in the purge passage on the control valve side; and adjust the flow rate of the gas discharged from the pump to the purge passage on the control valve side by using the specified one pump characteristic data to adjust the divergence of the control valve.

* * * * *